US007632029B2

(12) United States Patent
Kawaguchi

(10) Patent No.: US 7,632,029 B2
(45) Date of Patent: Dec. 15, 2009

(54) RECORDING APPARATUS

(75) Inventor: Koichiro Kawaguchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 989 days.

(21) Appl. No.: 10/914,264

(22) Filed: Aug. 10, 2004

(65) Prior Publication Data

US 2005/0041054 A1 Feb. 24, 2005

(30) Foreign Application Priority Data

Aug. 20, 2003 (JP) ..... 2003-296195

(51) Int. Cl.
*B41J 3/407* (2006.01)

(52) U.S. Cl. ..... 400/59; 400/56; 400/61; 720/606; 720/601

(58) Field of Classification Search ..... 455/556.1, 455/557, 550.1, 90.3, 575.1, 575.8; 101/128.21, 101/35, 129, 41, 486, 21; 400/61, 582, 59, 400/55, 56, 521, 541; 355/69; 720/606, 720/601; 347/104, 101, 8, 19
See application file for complete search history.

(56) References Cited

U.S. PATENT DOCUMENTS 5,502,542 A * 3/1996 Takano ..... 355/69
5,982,400 A 11/1999 Yokoi et al. ..... 346/134
6,092,893 A 7/2000 Yokoi et al. ..... 347/104
6,170,817 B1 1/2001 Kawaguchi ..... 271/167
6,508,169 B1 * 1/2003 Sato ..... 101/128.21
7,191,455 B2 * 3/2007 Murata et al. ..... 720/626
2002/0067940 A1 * 6/2002 Sasai et al. ..... 400/61
2002/0114655 A1 8/2002 Kawaguchi et al. ..... 400/578
2003/0030712 A1 2/2003 Kawaguchi et al. ..... 347/104
2003/0118370 A1 * 6/2003 Okabe et al. ..... 399/113
2003/0234852 A1 * 12/2003 Oshima et al. ..... 347/104
2004/0061757 A1 4/2004 Yanagi et al. ..... 347/101

* cited by examiner

*Primary Examiner*—John Lee
(74) *Attorney, Agent, or Firm*—Fitzpatrick, Cella, Harper & Scinto

(57) ABSTRACT

Disclosed is a recording apparatus that can accurately detect the position of a recording member, such as thick paper or a CD-R, that is mounted on a tray, that can, as much as possible, protect to-be-detected portions from being scratched, and that can perform accurate printing using a simple structure.

With a configuration wherein a recording member such as thick paper or a CD-R is mounted on a tray, and wherein the recording member is printed while the tray is conveyed, a reference position detection mark, which is a to-be-detected portion, is attached to the tray from the reverse face, and the edges of a reference position detection mark that has been detected are made as the edges of a hole portion that is formed in the tray.

7 Claims, 24 Drawing Sheets

RECORDING APPARATUS

BACKGROUND OF THE INVENTION

1. Field of the Invention

The present invention relates to a recording apparatus, such as a printer, and to such a recording apparatus that is capable of recording a recording member mounted on a tray with conveying the tray.

2. Related Background Art

As recording materials to be recorded by recording apparatuses, such as printers, there have been proposed a variety of media types, including small, thick recording members such as CD-Rs, DVDs and cards (hereinafter, collectively referred to as compact disks or CDs). However, when a currently available general-purpose recording apparatus, is used for the printing of a recording member such as a CD, since the recording apparatus uses the same path for conveying the recording member as it uses for a cut sheet, the high rigidity of the recording member causes the performance of the conveying process to be degraded, and either the recording member is scratched or it is not conveyed because of the distance between the feed rollers. To avoid this problem, a tray is supplied for mounting the recording member, which is thereafter conveyed along a path differing from the one used for a cut sheet.

When a recording member such as a CD is being recorded, a sensor mounted on a carriage detects a reflection plate formed on a tray to determine the recording position of the CD and performs recording. The reflection plate is formed on a raised surface on a resin tray by hot stamping. In addition, to increase the detection accuracy of reading the reflection plate, an inclined surface is formed around the reflection plate (see FIG. 16). Further, to simplify the provision of a reflection plate, hot stamping is used to form it directly on the flat surface of the tray.

However, the following technical problems have been encountered. First, when edging at the end of the raised portion of the tray is not properly performed before the hot stamping, a reflection face edge can not be appropriately formed and detection errors may occur. Therefore, the edging of the resin must be strictly managed, which will require an inspection fee, and lessen the yield ratio, resulting in an increase in the manufacturing costs. Second, since the reflection face is formed on the raised portion of the resin, the end of the raised portion may be scratched, depending on how the tray is handled, and detection errors may occur. Third, in a case where hot stamping is used to form the reflection face directly on the surface of the tray, printing shifting caused by the hot stamping and chipping of the end portion may occur, so that there may be detection errors. Fourth, when a user erroneously sets the tray in a reverse direction to a normal one, printing may be performed on a portion other than where a CD is mounted.

SUMMARY OF THE INVENTION

It is one objective of the present invention to provide a recording apparatus that employs a tray for a thick paper, a CD-R, etc, accurately conduct recording at a low cost.

DETAILED DESCRIPTION OF THE PREFERRED EMBODIMENTS

Figure 1:
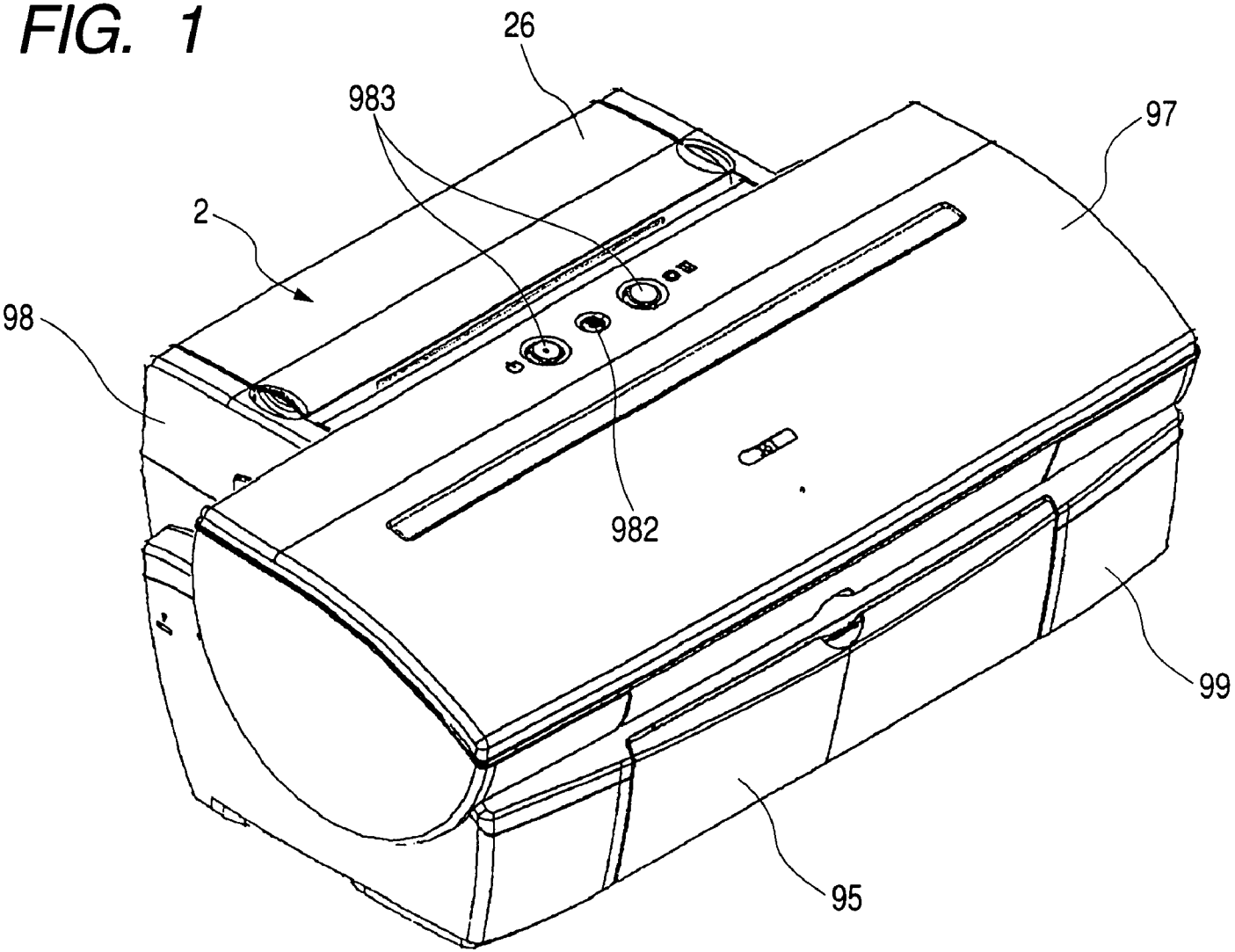
FIG. 1 is a perspective view of a recording apparatus according to the present invention.
Figure 2:
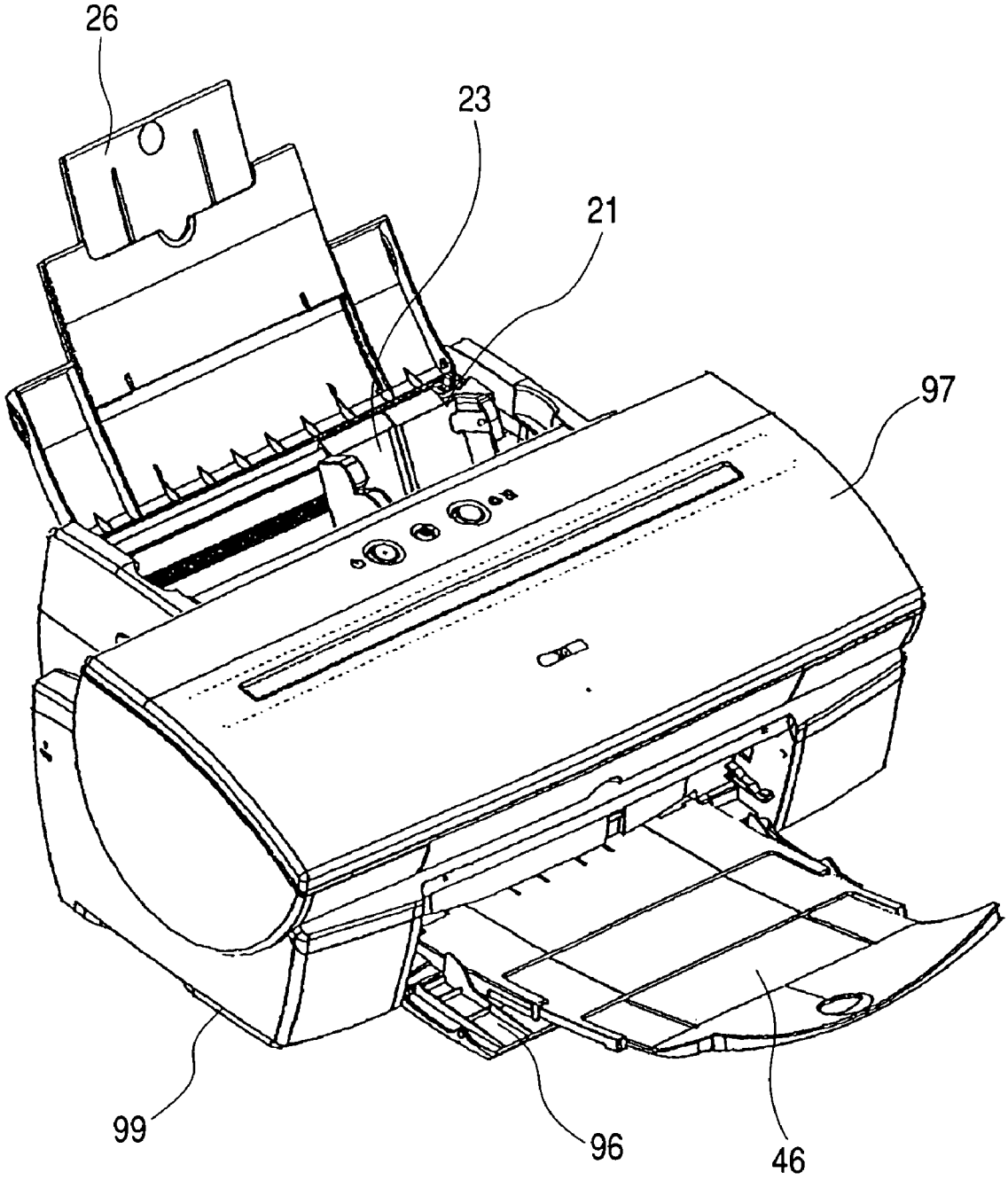
FIG. 2 is a perspective view of the recording apparatus in FIG. 1 wherein a paper supply tray and a paper discharge tray are open.
Figure 3:
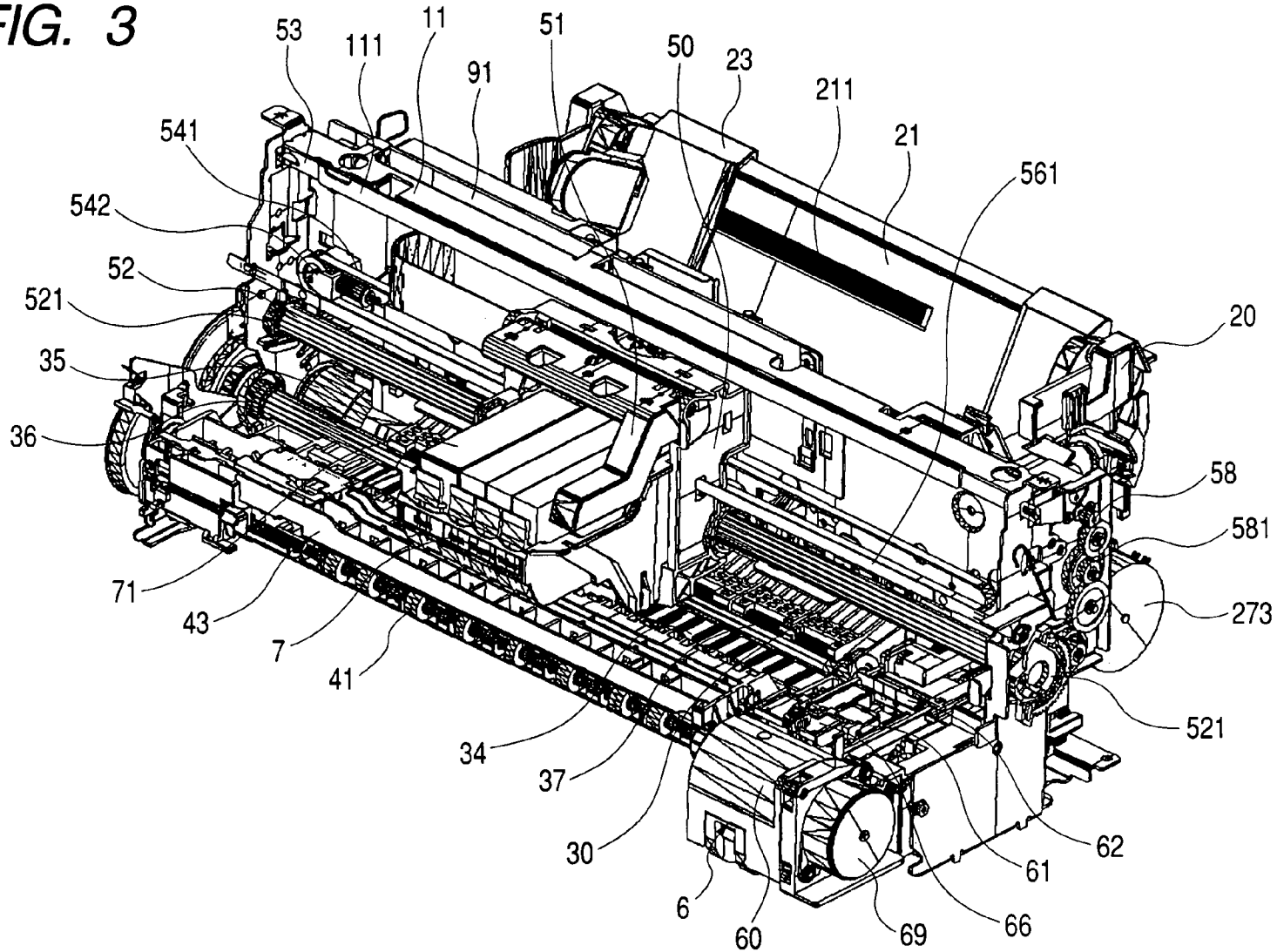
FIG. 3 is a perspective view, taken from the right front, of the internal arrangement of the recording apparatus in FIG. 1.
Figure 4:
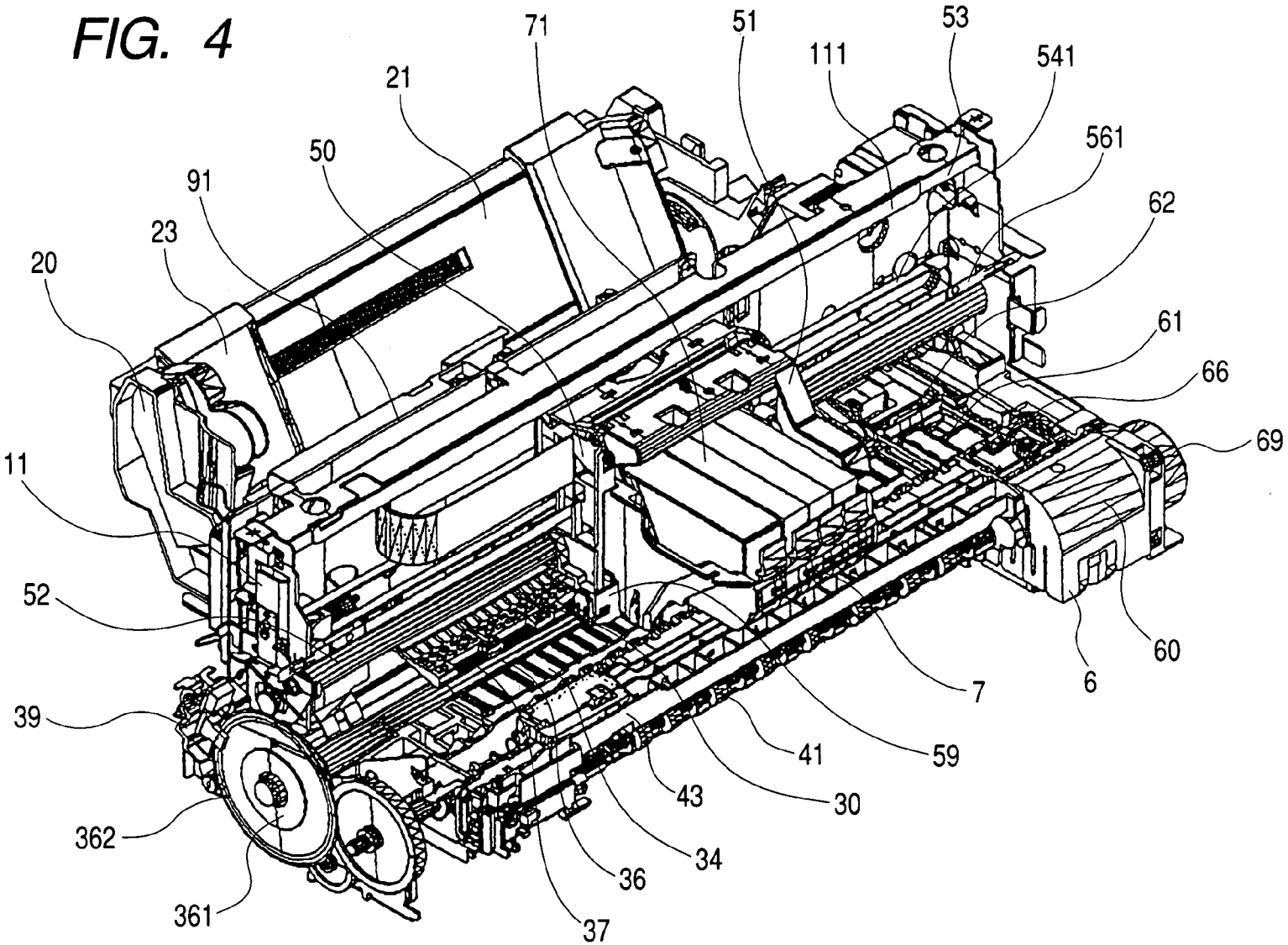
FIG. 4 is a perspective view, taken from the left front, of the internal arrangement of the recording apparatus in FIG. 1.
Figure 5:
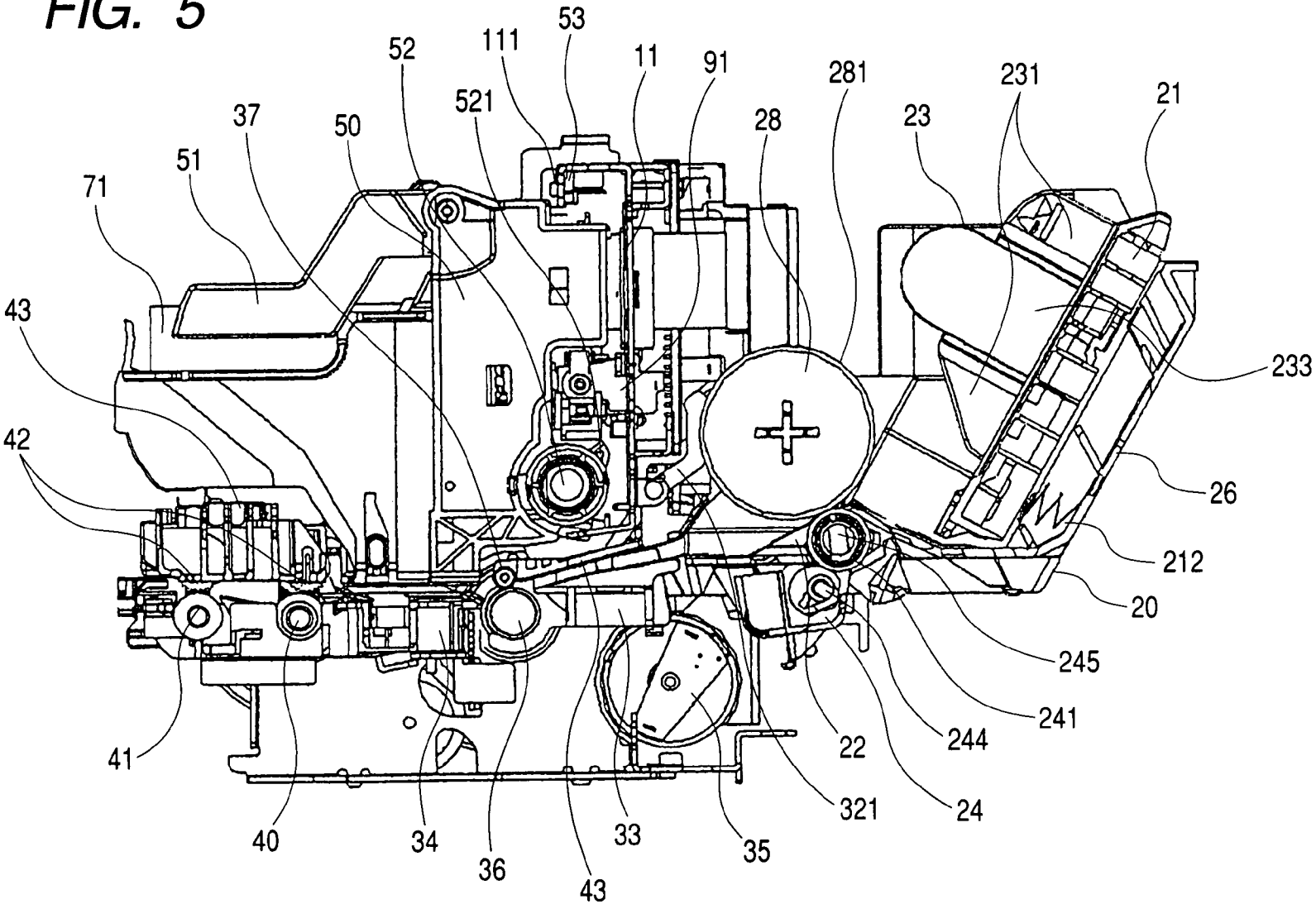
FIG. 5 is a vertical cross-sectional view of the recording apparatus in FIG. 3.

The preferred embodiments of the present invention will now be specifically explained while referring to the accompanying drawings. Throughout the drawings, the same reference numerals are employed to denote identical or corresponding components. FIG. 1 is a perspective view of a recording apparatus according to the present invention, and FIG. 2 is a perspective view of the recording apparatus in FIG. 1, wherein a paper supply tray and a paper discharge tray are open. FIG. 3 is a perspective view, taken from the right front, of the internal arrangement of the recording apparatus in FIG. 1, and FIG. 4 is a perspective view, taken from the left front, of the internal arrangement of the recording apparatus in FIG. 1. FIG. 5 is a vertical cross-sectional view of the recording apparatus in FIG. 3. In FIGS. 1 to 5, a recording apparatus 1 comprises a paper supply unit 2, a sheet conveying unit 3, a paper discharge unit 4, a carriage 5, a cleaning unit (recovery mechanism) 6, a recording head (recording means) 7, a CD conveying unit 8 and an electric unit 9.

For the paper supply unit 2, a pressure plate 21, on which sheets P, such as recording sheets, are mounted, a feed roller 28, for feeding a sheet P, a separation roller 241, for separating sheets P, and a return lever 22, for returning sheets P to a stacked position, are attached to a base 20. A paper supply tray 26, used for holding the sheets P in the stacked position, is attached to the base 20 or the outer case of the recording apparatus 1. As is shown in FIG. 2, the paper supply tray 26 is a multistage type, and is pulled out for use. The feed roller 28 is rod-like and of circular arc in cross section, on which rubber material is provided, at a position loses to a sheet reference, and is used to feed a sheet P. The feed roller 28 is driven by a driving force transmitted by a feed motor 273, which is provided in the paper supply unit 2, through a drive transmission gear 271 and a planetary gear 272.

In the normal standby state, the pressure plate 21 is released by a pressure plate cam 214, the separation roller 241 is released by a control cam 25, and the return lever 22 is located at a stacking position whereat the sheets P are returned to the stacking position and a stacking port is blocked to prevent the stacked sheets P from entering farther. When the supply of paper is started, first, the motor drives the separation roller 241 to contact the feed roller 28. Then, the return lever 22 is released, and the pressure plate 21 is brought into contact with the feed roller 28. In this state, the supply of the sheet P is begun. The sheets P are controlled by a front stage separation unit 201, which is provided on the base 20, and only a predetermined number of sheets P are transmitted to a nip portion that is formed by the feed roller 28 and the separation roller 241. The sheets P are separated at the nip portion, and only the topmost sheet P is fed.

The sheet conveying unit 3 is attached to a chassis 11 made of bent sheet metal, and includes a conveying roller 36, for conveying the sheet P, and a PE sensor 32. The conveying roller 36 is formed by coating the surface of a metal shaft with ceramic particles, and is attached to the chassis 11 by holding the metal portions of the shaft at a bearing 38. In order to stably convey a sheet P by using the conveying roller 36, a conveying roller tension spring 381 is located between the bearing 38 and the conveying roller 36. When the conveying roller tension spring 381 urges the conveying roller 36 forward, a predetermined load is imposed on the conveying roller 36.

A plurality of coupled, driving pinch rollers 37 are so provided that they contact the conveying roller 36. The pinch rollers 37 are held by a pinch roller holder 30, and are pressed against the conveying roller 36 by a pinch roller spring 31 to generate a conveying force for the sheet P. The rotary shaft of the pinch roller holder 30 is fitted on a fearing and the pinch roller holder 30 rotates around the rotary shaft. A paper guide flapper 33 and a platen 34, for guiding the sheet P, are arranged at the entrance of the paper conveying unit 3 to which the sheet P is to be conveyed. And the pinch roller holder 30 includes a PE sensor lever 32 for notifying the PE sensor 32 when the leading edge or the trailing edge of the sheet P has been detected.

The platen 34 is attached to and positioned on the chassis 11. The paper guide flapper 33 is rotatable at a bearing 331 that engages the conveying roller 36 and slides backward and forward, and it is positioned by contacting with the chassis 11. A paper release lever 341, for covering the end of the sheet P, is located on the paper reference side of the platen 34, and for a sheet P having a deformed or curled end, the paper release lever 341 prevents the end of the sheet P from being raised and interfering with the carriage 50 or the recording head 7. The recording head 7, for recording images based on image data, is located downstream, in a sheet conveying direction the conveying roller 36.

With this arrangement, the sheet P conveyed to the paper conveying unit 3 is guided by the pinch roller holder 30 and the paper guide flapper 33, and is fed to the conveying roller pair consisting of the conveying roller 36 and the pinch roller 37. At this time, the leading edge of the sheet P conveyed by the pinch sensor lever 321 is detected to obtain the recording position of the sheet P, while, as the paired conveying rollers 36 and 37 are rotated by a conveying motor 35, the sheet P is transmitted along the platen 34. On the platen 34, a rib is formed that acts as a conveying reference face and that manages a gap between it and the recording head 7 and that, together with the paper discharge unit, which will be described later, reduces undulation of the sheet P.

The conveying roller 36 is driven by the transmission of the rotational force of the conveying motor 35 being a DC motor, to a pulley 361 that is fitted around the shaft of the convey roller 36, by a timing belt 351. A cord wheel 362, on which marks are formed, at pitches of 150 to 300 lpi, to detect an amount of the sheet conveyance by the convey roller 36, is provided on the shaft of the conveying roller 36, and an encoder sensor 36, for reading the marks, is attached to the chassis 11 at a position adjacent to the cord wheel 362. As for the recording head 7, an ink jet recording head, is used which has exchangeable ink tanks for individual colors mounted therein. This recording head F is arranged to heat inks by using a heater (a heat-generating device) or the like. When the ink is heated, film boiling occurs, whereby bubbles are expanded or shrunk to cause change in the pressure and thus eject ink, through orifices in the recording head 7. By the ejected ink droplets, an image is formed on a recording material, such as the sheet P.

The carriage unit 5 includes the carriage 50, on which the recording head 7 is mounted. The carriage 50, supported by a guide shaft 52 and a guide rail 111 positioned perpendicular to the direction in which the sheet P is conveyed, reciprocates in the main scanning direction, and is driven, via a timing belt 541 extended by an idle pulley 542, by a carriage motor 54 that is attached to the chassis 11. Further, in order to detect the location of the carriage 50, a cord strip 561, whereon marks are formed at pitches of 150 to 300 lpi, is positioned parallel to the timing belt 541, and an encoder sensor 56, for reading the cord strip 561, is provided on a carriage board 92 mounted on the carriage 50. Also provided on the carriage board 92 is a contact 921 used for an electric connection to the recording head 7. Furthermore, a flexible board 57 for transmitting a head signal from an electric unit (electric board) 9 to the recording head 7, is also provided in the carriage 50.

In order to secure the recording head 7 to the carriage 50, pressing means 511 is provided in the carriage 50 to push and securely fix the recording head 7 against a positioning stopper 501. Eccentric cams 521 are provided on both ends of the guide shaft 52, and when the driving force produced by a carriage elevating motor 58 is transmitted to the eccentric cams 521, through a gear string 581, the guide shaft 52 is either elevated or lowered. As the guide shaft 52 is elevated or lowered, the carriage 50 is also elevated or lowered, and an optimum gap can be formed for sheets P of different thicknesses.

A sensor 59, which is a reflector type optical sensor, is attached to the carriage 50 to detect a to-be-detected portion (to-be-detected portion or detection mark) 834 on a CD printing tray 83, which will be described later. For recording performed on the display portion of a small, thick recording material, such as a CD-R, the tray 83 is conveyed with the small, thick recording material mounted thereon. The sensor 59 emits light by using a light emitting device and receives reflected light to thereby detect the location of the tray 83. With this arrangement, to record the sheet P, the paired convey rollers 36 and 37 convey the sheet P to the position for a row to be recorded, and the carriage motor 54 moves the carriage 50 to a recording position to cause the recording head 7 to face the recording location. Thereafter, upon receiving a signal from the electric unit 9, the recording head 7 ejects ink onto the sheet P, and as a result, forms an image thereon.

The paper discharge unit 4 includes: two discharge rollers 40 and 41, which are attached to the platen 34; spurs 42, which can perform coupled driving, under a predetermined pressure, while in contact with the discharge rollers 40 and 41; and a gear string for transmitting the driving force from the conveying roller 36 to the discharge rollers 40 and 41. A plurality of rubber portions (discharge roller rubber) 401 are provided around the metal shaft of the discharge roller 40, which is located upstream in the sheet conveying direction, and the discharge roller 40 is driven by a driving force from the conveying roller 36 transmitted by an idler gear. The discharge roller 41 that is located downstream, is so structured that a plurality of flexible members 411, composed of elastomer, are provided around the resin shaft. The discharge roller 41 is driven by a driving force from the discharge roller 40 transmitted via the idler gear.

The spurs 42 are attached to a spur holder 43, and in the present invention, a spur spring 44, which is a coil spring having a rod-like shape, is employed to attach the spurs 42 to the spur holder 43 and to apply pressure, through the spurs 42, to the discharge rollers 40 and 41. As for the spurs 42, there are two types: a type that mainly generates a force for conveying a sheet P, and a type that mainly prevents a sheet P from being raised during a recording operation. The spur that generates the conveying force is located at a position corresponding to the rubber portion (a discharge roller rubber portion or a flexible member portion) of the discharge roller 40 or 41, and the spur that prevents the sheet P from being raised is located at a position (between the rubber portions 401) whereat the rubber portions 401 of the discharge rollers 40 and 41 are not present.

A paper end support 45, arranged between the discharge rollers 40 and 41, raises both ends of a sheet P 40 and 41, to hold the sheet P ahead thereof so that an image recorded on the sheet P discharged previously is protected from damage or quality deterioration due to rubbing. For the paper end support 45, a resin member, whereon a roller 451 is located at the distal end, is urged by a paper end support spring 452. In this manner, both ends of the sheet P are raised and held to provide a tear-resistant body.

With the above described arrangement, the sheet P on which an image is formed by the carriage unit 5 is conveyed while sandwiched by the nip portion between the discharge roller 41 and the spur 42, and is discharged to a paper discharge tray 46. The paper discharge tray 46 has a segmented structure and is composed of a plurality of members, and can be stored in the lower portion of a lower case 99 of the recording apparatus 1. The paper discharge tray 46 is pulled out for use. In the drawings, the height of the paper discharge tray 46 increases toward the tip, and the side edges of the tray are also high. With this structure, discharged sheets P can be stacked more appropriately, and the recording faces of the sheets P can be protected from rubbing.

The cleaning unit (recovery mechanism) 6 includes: a suction pump 60, for performing a suction recovery process to maintain or recover the ejection performance of the recording head 7; a cap 61, for protecting the orifice faces of the recording head 7 and preventing the drying of the orifices; a wiper blade 62, for removing an extraneous substance, such as ink or dust, from the area around the orifices of the recording head 7; and a special recovery motor 69. The cleaning unit 6 also includes a one-way clutch 691, for driving the suction pump 60 by employing the uni-directional rotation of the recovery motor 69 to operate the wiper blade 62 and elevate the cap 61.

The suction pump 60 generates a negative pressure by using a pump roller 68 to rub or stroke two tubes 67, and the suction pump 60 and the cap 61 are connected via a valve 65 or the like. The suction recovery means, which includes the suction pump 60, drives the suction pump 60 and generates a negative pressure in the cap 61 that closely seals the orifice face of the recording head 7, and under this negative pressure, a foreign substance, such as viscous ink, bubbles or dust, so well as ink is attracted to and discharged from the orifices of the recording head 7. A cap absorption member 611 is provided on the cap 61 to reduce the quantity of ink remaining in the orifices after the suction process has been performed. To prevent the residual and fixation of ink and the occurrence of damage owing to the fixation ink remaining in the cap 61 is attracted while the cap 61 is open. The waste ink sucked by the pump 60 is collected and held by a waste ink absorption member 991 (FIG. 9) provided in the lower case 99, which will be described later.

The individual functional units described above, which are assembled within the chassis 11 of the recording apparatus 1, provide the mechanisms for the recording apparatus 1, and to enclose these mechanisms, an outer case is attached. The outer case is constituted mainly by a lower case 99, an upper case 98, an access cover 97, a connector cover 96 and a front cover 95. A paper discharge tray rail 992 is provided in the lower portion of the lower case 99 to store the segmented (extendable) paper discharge tray 46. And the front cover 95 closes the paper discharge port when the paper discharge tray 46 is not in use.

Figure 6A:
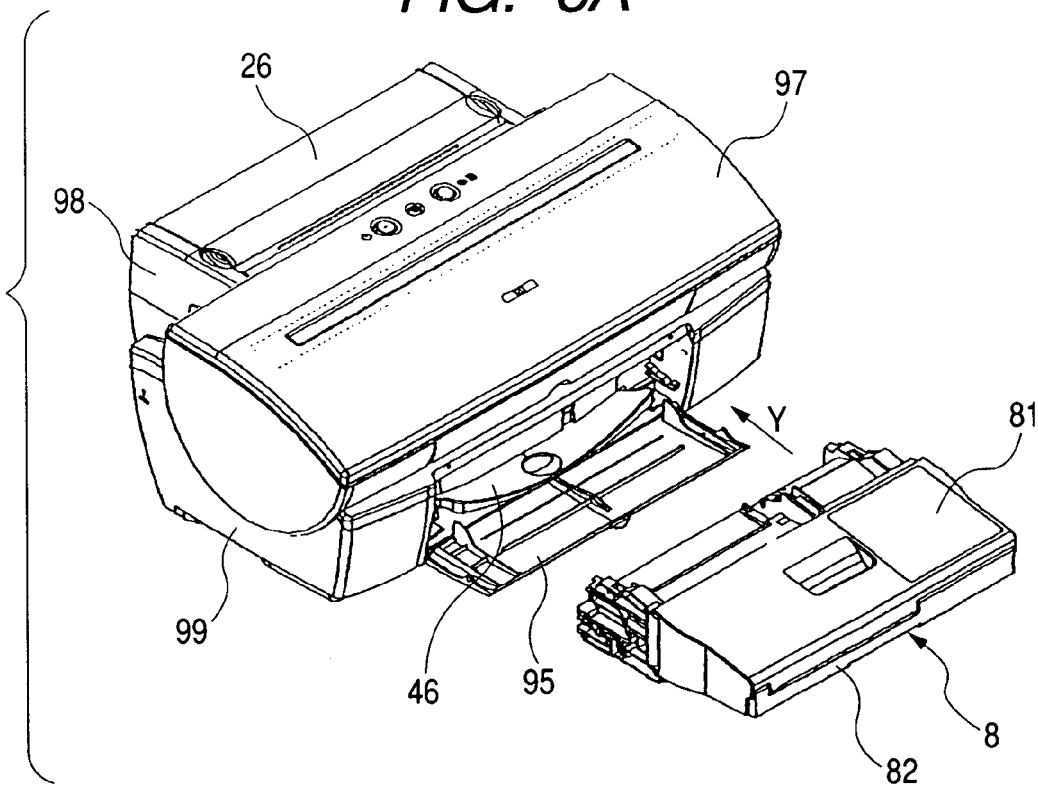
FIGS. 6A and 6B are, respectively, perspective views of the recording apparatus in FIG. 1 before and after a CD conveying unit is mounted.
Figure 6B:
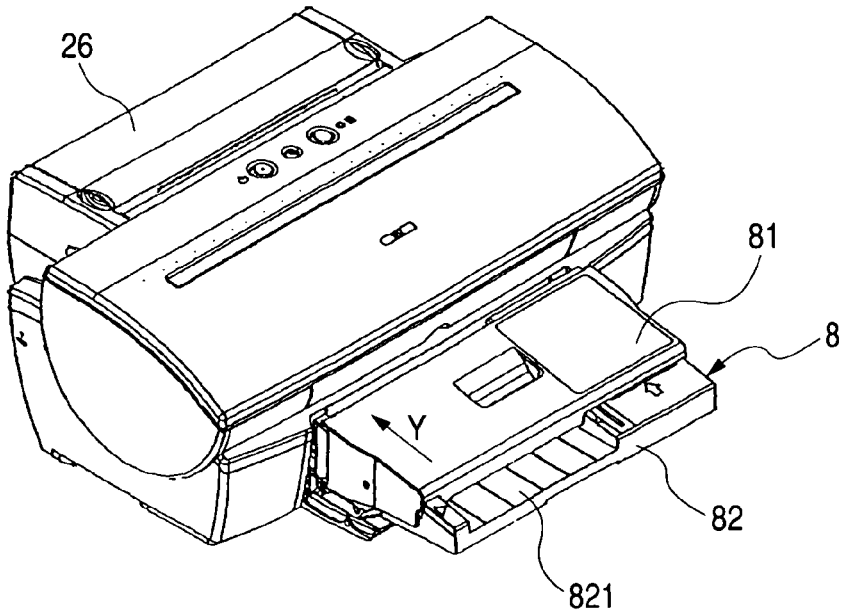
Figure 7:
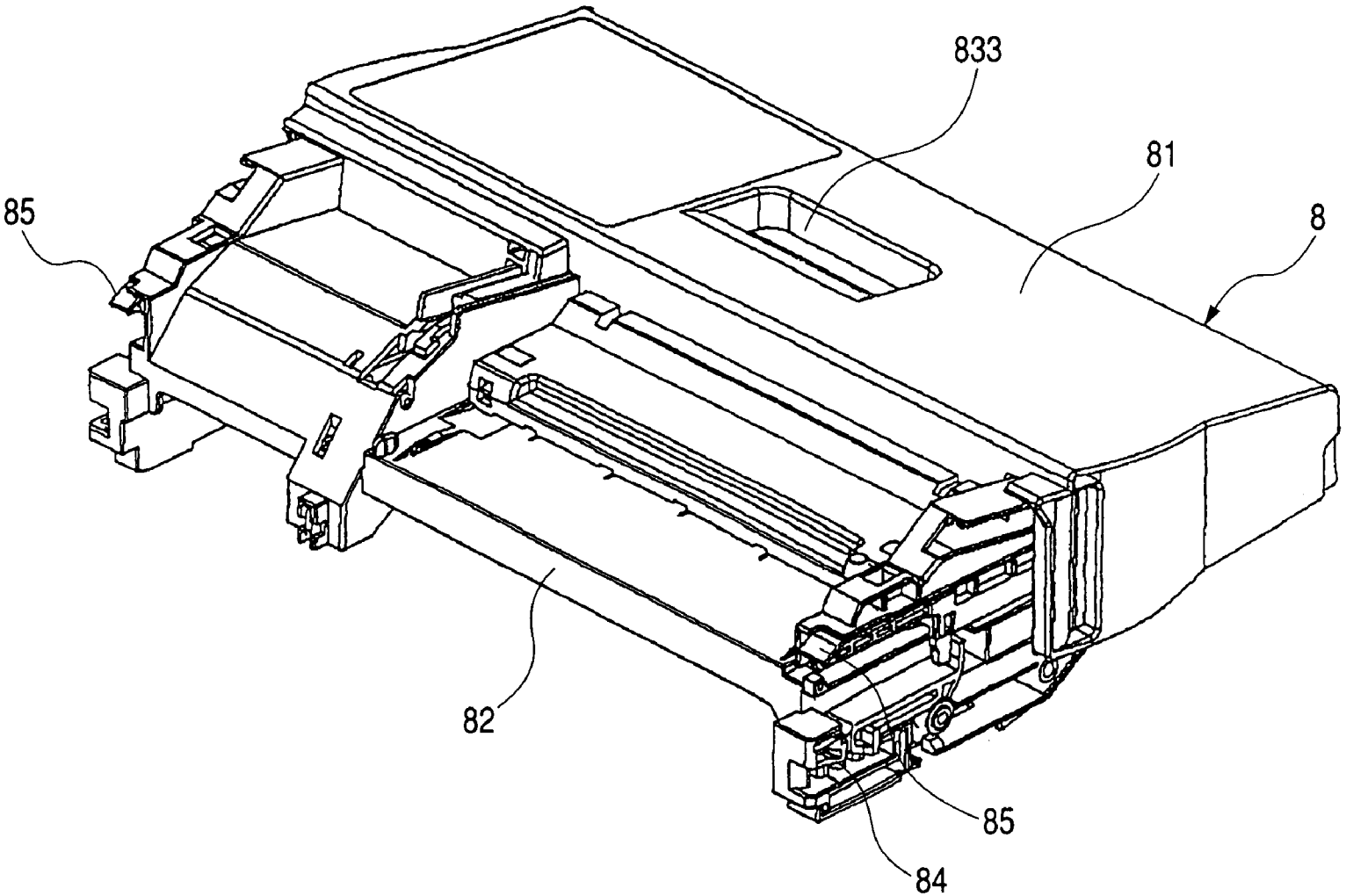
FIG. 7 is a perspective view of the CD conveying unit that can be mounted in the recording apparatus in FIG. 1.
Figure 8:
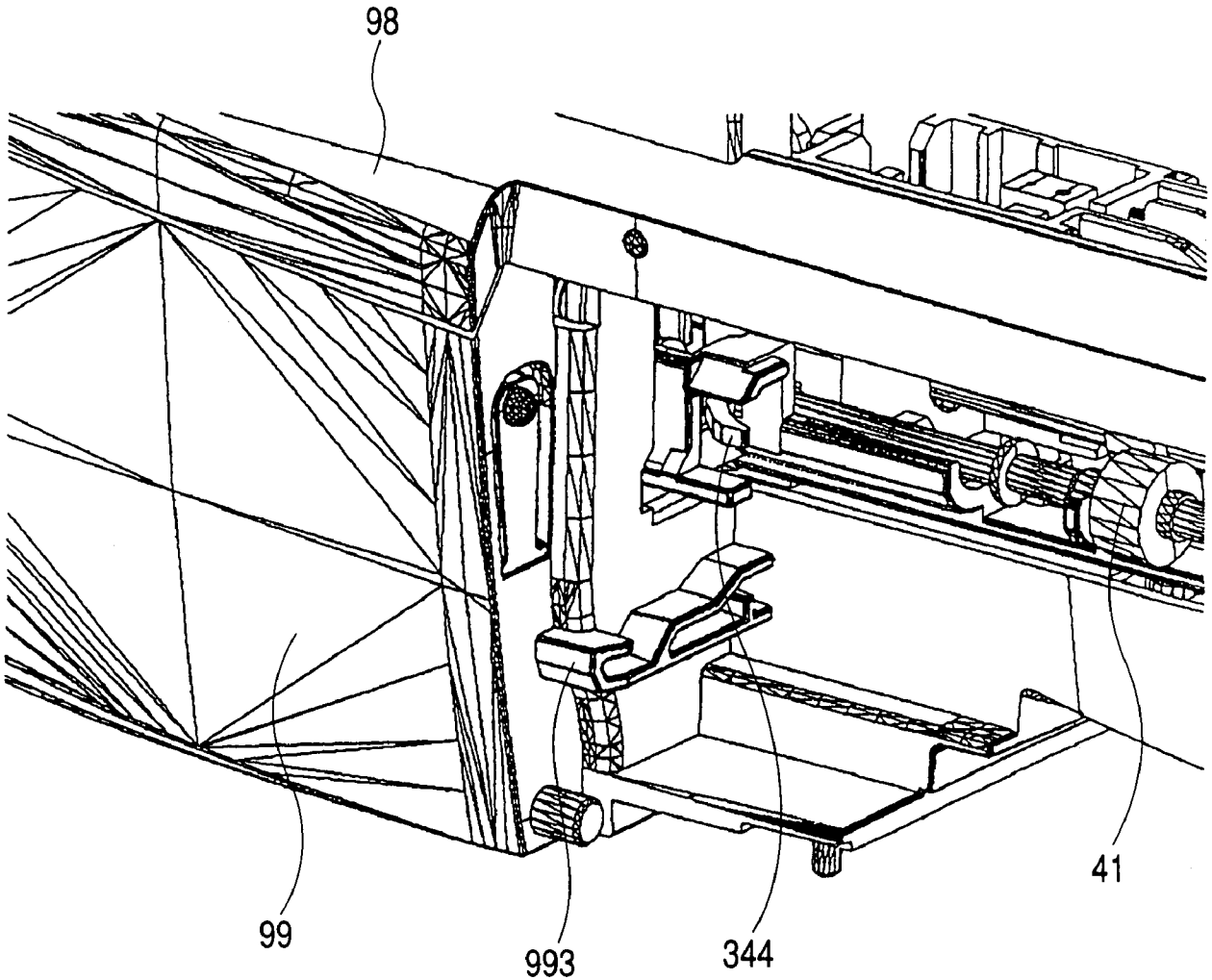
FIG. 8 is a fragmentary perspective view of a CD conveying unit attachment portion and an attachment detector in the lower case of the recording apparatus in FIG. 1.
Figure 9:
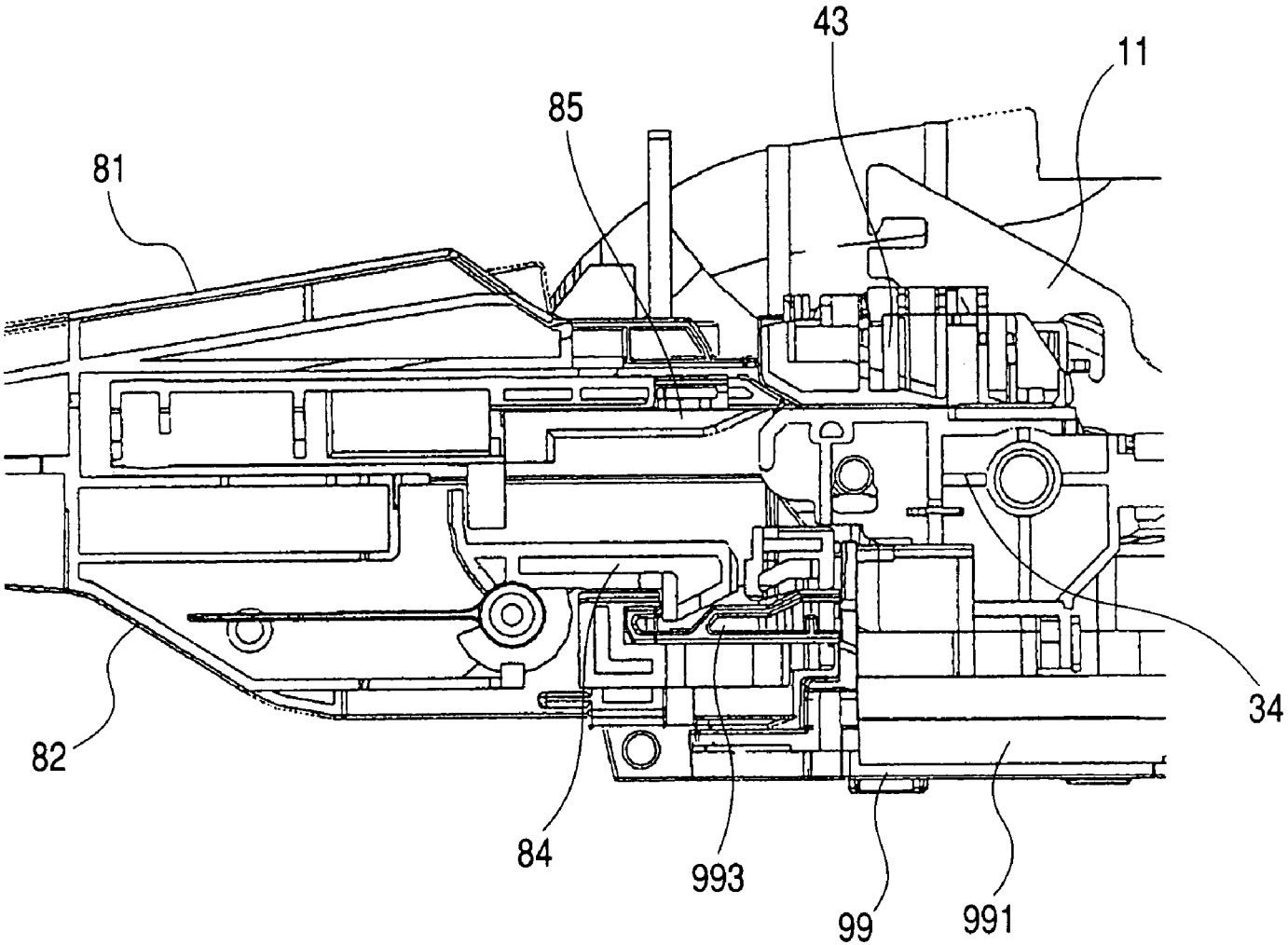
FIG. 9 is a fragmentary vertical cross-sectional view of the state wherein a hook of the CD conveying unit engages the lower case of the recording apparatus in FIG. 1.
Figure 10A:
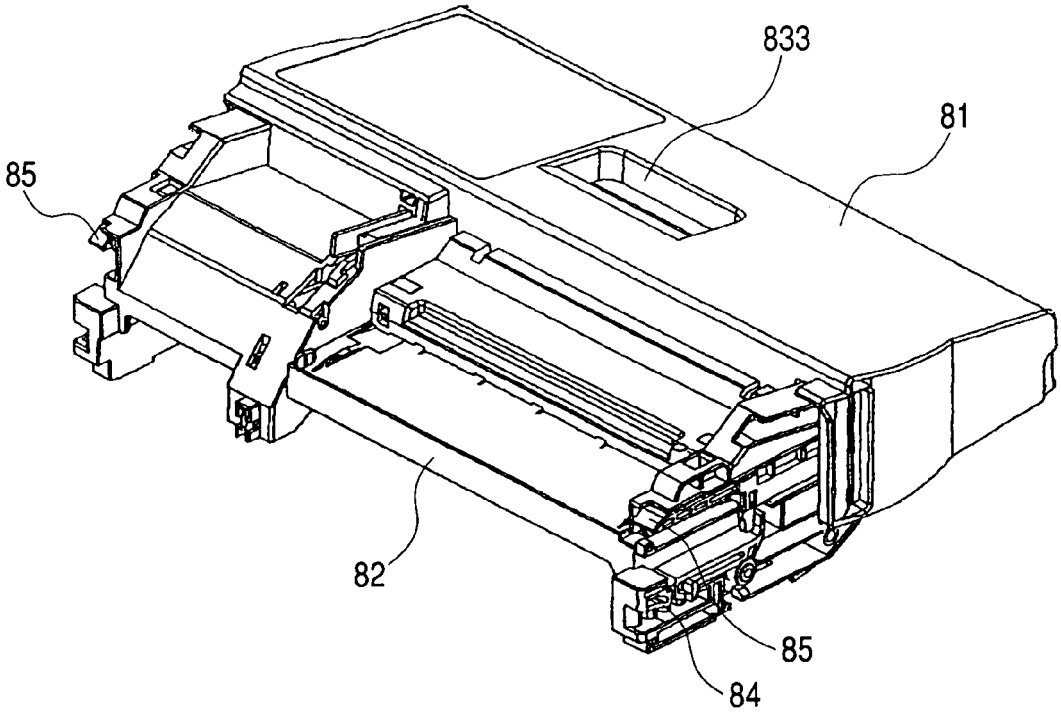
FIGS. 10A and 10B are, respectively, perspective views of the states wherein a slide cover is moved before and after the CD conveying unit is mounted.
Figure 10B:
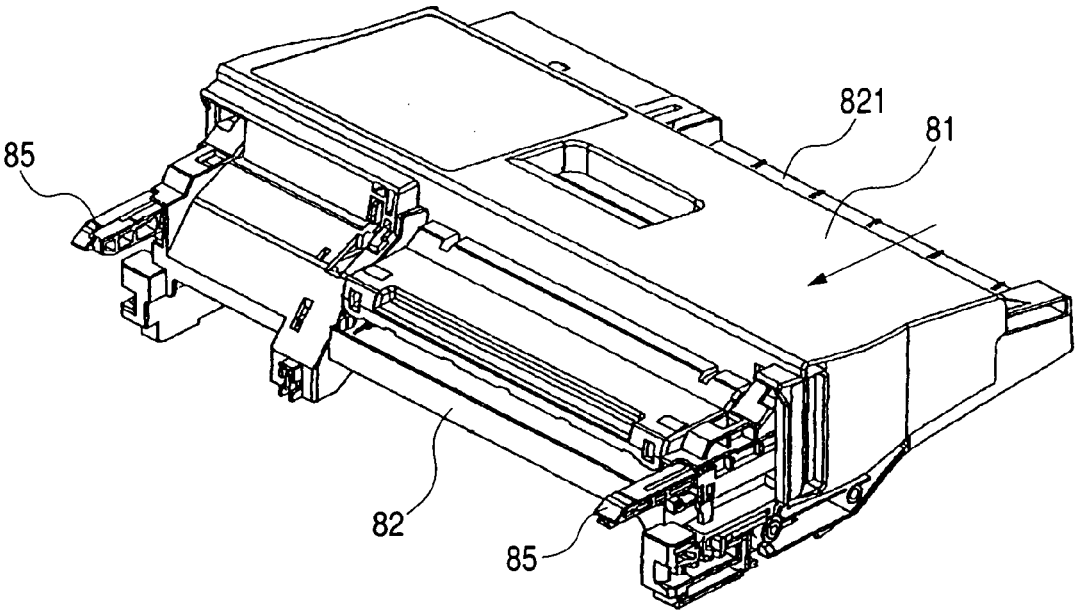
Figure 11:
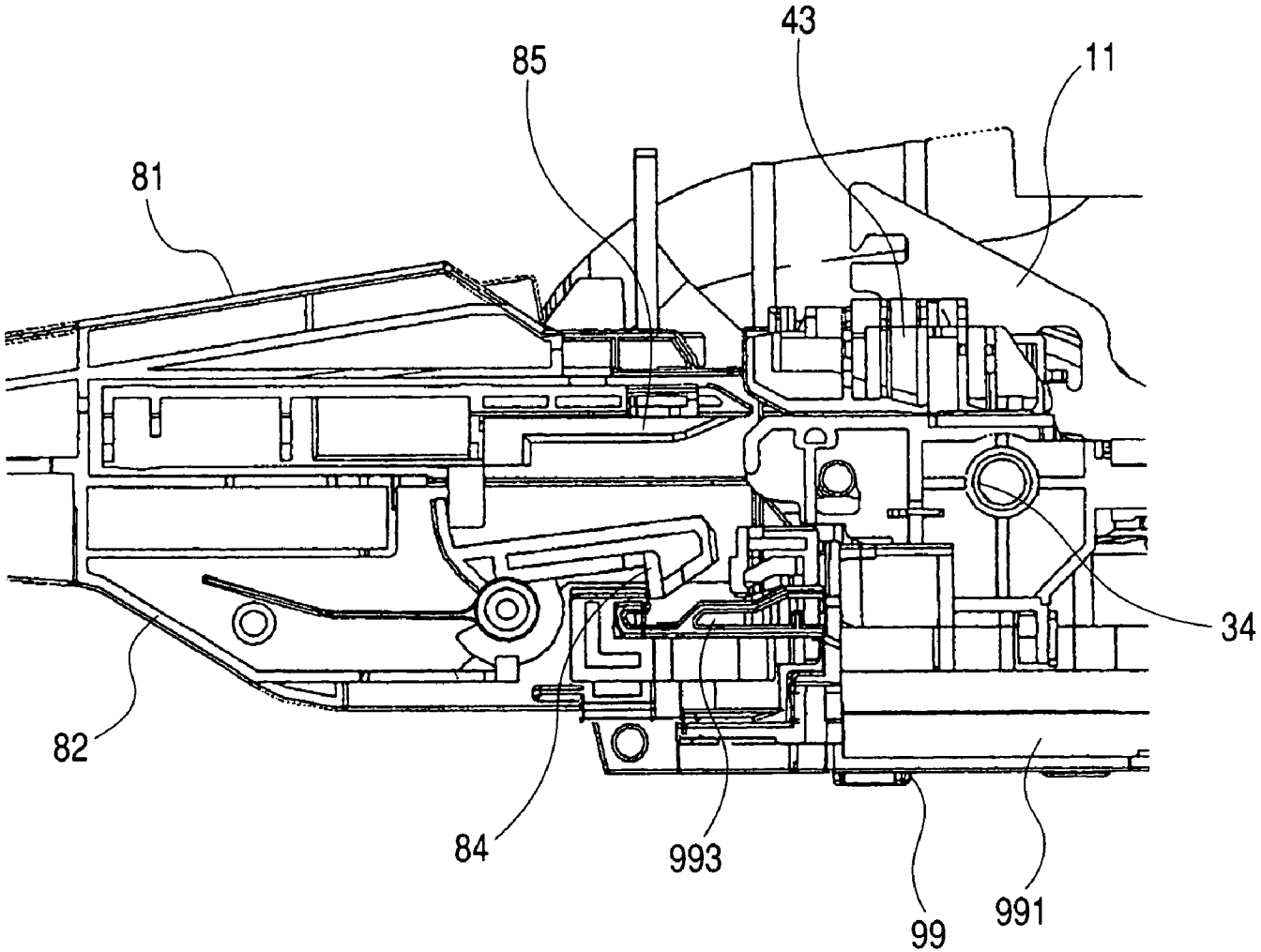
FIG. 11 is a fragmentary vertical cross-sectional view of the state wherein the hook of the conveying unit is disengaged from the lower case of the recording apparatus.
Figure 12A:
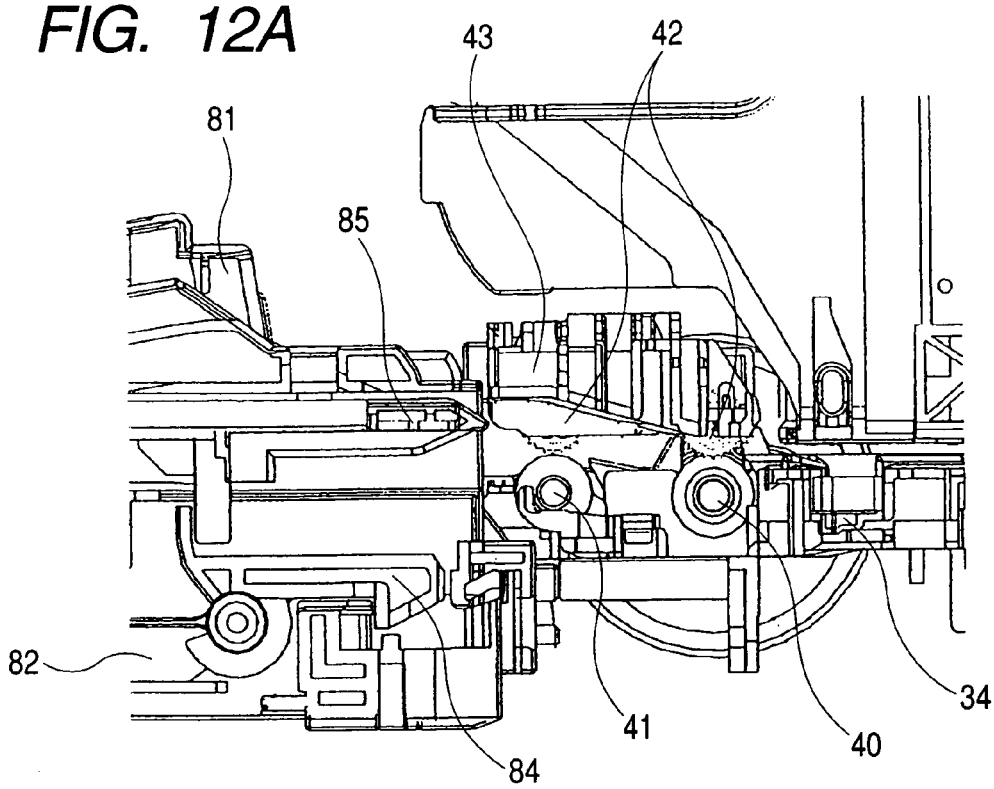
FIGS. 12A and 12B are, respectively, fragmentary vertical cross-sectional views of the states of an arm before and after the slide cover of the CD conveying unit is moved.
Figure 12B:
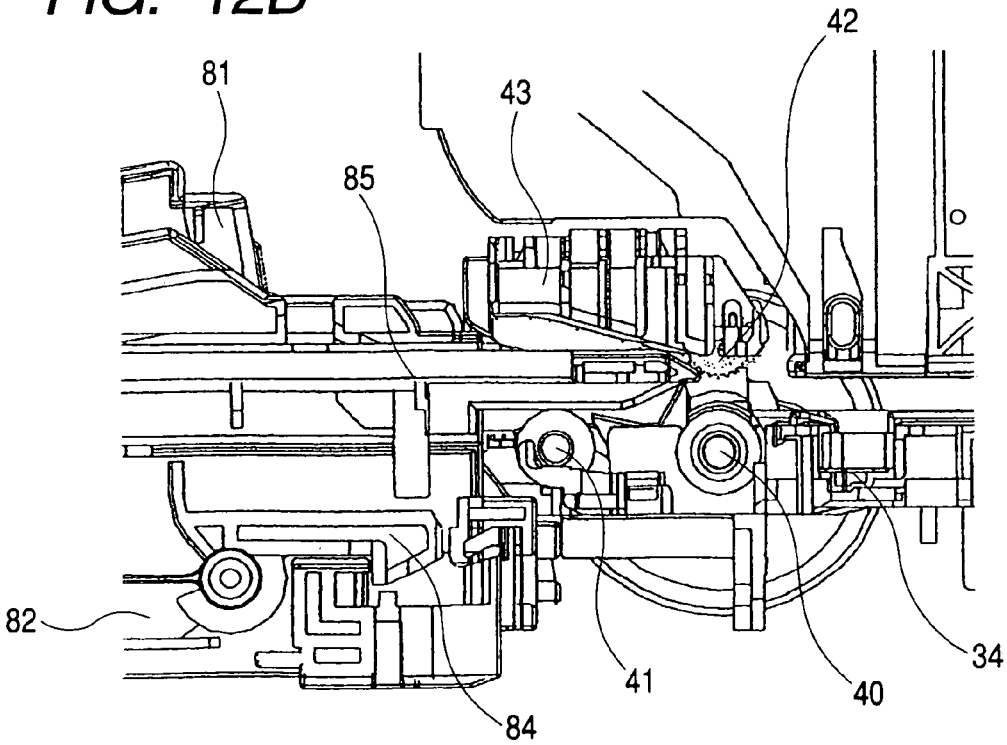
Figure 13:
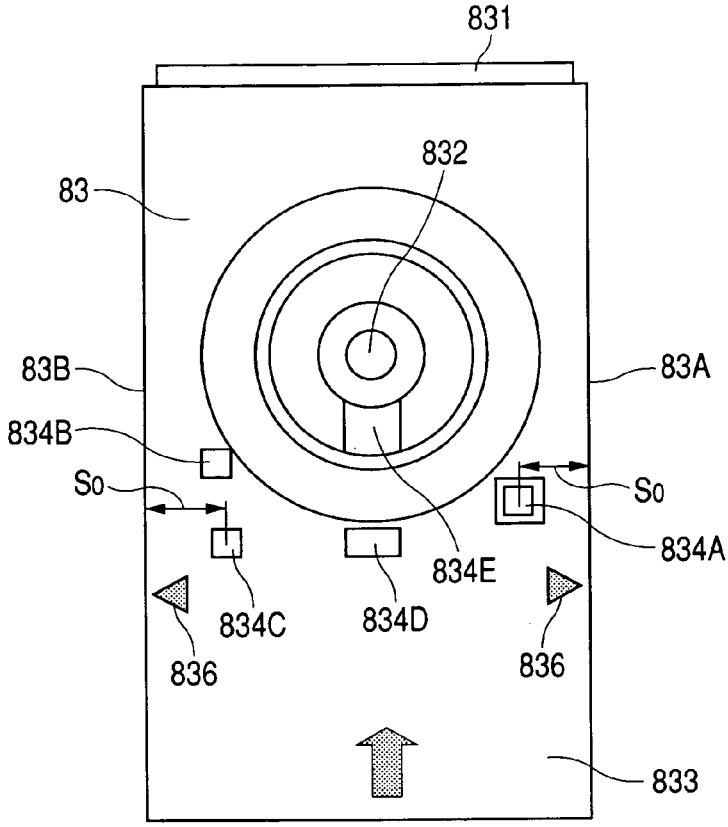
FIG. 13 is a schematic plan view showing on a tray a means for calculating a recording position of a CD in the recording apparatus according to the present invention.

A detailed explanation will now be given for the configuration of and the printing processing performed by the recording apparatus when an image is printed on the surface of a compact disc (CD). This CD printing processing is performed by using the CD conveying unit 8 provided in the recording apparatus. FIGS. 6A and 6B are respective views of the recording apparatus before and after the CD conveying unit 8 is mounted. FIG. 7 is a perspective view of the CD conveying unit 8 that can be mounted in the recording apparatus in FIG. 1. FIG. 8 is a fragmentary perspective view of the CD conveying unit attachment portion and the attachment detector of the lower case 99 for the recording apparatus in FIG. 1. FIG. 9 is a fragmentary vertical cross-sectional view of the state wherein hooks 84, provided in the CD conveying unit 8, engage the lower case 99 of the recording apparatus in FIG. 1. FIGS. 10A and 10B are respective perspective views of the states wherein a slide cover 81 is moved before and after the CD conveying unit 8 is mounted. FIG. 11 is a fragmentary vertical cross-sectional view of the state wherein the hooks 84 on the CD conveying unit 8 are disengaged from the lower case. FIGS. 12A and 12B are respective fragmentary vertical cross-sectional views of the states of arms 85 before and after a slide cover 81 of the CD conveying unit 8 is moved. And FIG. 13 is a schematic plan view showing on a tray a means for calculating a recording position of a CD in the recording apparatus of the present invention.

As is shown in FIGS. 6A and 6B, when the CD conveying unit 8 is slid linearly in the direction Y, the CD conveying unit 8 is attached to the lower case 99 of the recording apparatus 1. At this time, engagement portions 822, at both side ends of a tray guide 82, are inserted along guide rails 993, provided on both sides of the lower case 99 shown in FIGS. 8 and 9, to position the CD conveying unit 8. The pivotable hooks 84 are provided at both ends of the tray guide 82 and are urged in one direction. When the CD conveying unit 8 is inserted and moved to a predetermined position, it abuts upon a predetermined portion that prevents its further insertion. Then, the hooks 84, by engaging the stopper of the guide rails 993, lock the CD conveying unit 8 in place and prevent it from returning in the direction in which it was slid.

A sensor 344 is provided for the platen 34 to mechanically detect the state wherein the tray guide 82 (tray conveying unit 8) has been mounted at a predetermined position in the recording apparatus 1. When the tray guide 82 is attached to the main body of the recording apparatus 1, a part of the tray guide 82 pushes the sensor 344, so that the sensor 344 can detect the mounting of the tray guide 82.

As is shown in FIGS. 10A, 10B, 12A and 12B, when the slide cover 81 is moved toward the main body of the recording apparatus 1, the arms 85 interact with the slide cover 81 and are projected outward toward the main body of the recording apparatus 1. The spur holder 43, which holds the spur 42, is so arranged that it is vertically displaceable regarding the platen 34, while being urged downward by a spring force that applies a predetermined pressure. Therefore, when the arms 85 are inserted between the spur holder 43 and the platen 34, the spur holder 43 is raised or lifted by a predetermined distance. At this time, sloping surfaces 851, which are formed at the distal ends of the arms 85, are employed to insert the arms 85 between the platen 34 and the spur holder 43. Through this process, a space can be defined, between the platen 34 and the spur holder 43, through which the tray 83 can be passed.

Before the arms 85, which are positioned with a state where it is inserted between the platen 34 and the spur holder 43, are projected (moved forward), they are stored, with adequate play, in the tray guide 82. Further, since an opening 821 in the CD conveying unit 8 is closed when the slide cover 81 is not moved toward the main body of the recording apparatus 1, the tray 83 can not be inserted. However, when the slide cover 81 is moved toward the main body of the recording apparatus 1, the slide cover 81 is shifted obliquely upward, so that the opening 821 for the tray insertion is obtained between the slide cover 81 and the tray guide 82. In this state, the tray 83 on which a CD is mounted can be inserted through the opening 821 and set in a predetermined position. With this configuration, if the tray 83 is inserted while the spur holder 43 is not elevated, the spur 42 can be prevented from interfering with the tray 83, and a tray sheet 831, at the distal end of the tray 83, and the spur 42 can be protected from being damaged.

As is shown in FIG. 11, when the slide cover 81 whereon the tray guide 82 is mounted is pulled out of the main body, the arms 85 interact with the slide cover 81 and are disengaged from the spur holder 43, and the spur holder 43 and the spur 44 are lowered to their original positions. At this time, in a case the tray 83 is maintained on the slide cover 81, the tray 83 is caught at the opening 821, formed between the slide cover 81 and the tray guide 82, and prevents the slide cover 81 from being pulled out farther. With this arrangement, it is possible to prevent the occurrence such a defect that, while a recording medium such as a CD-R is retained in the recording apparatus 1, the spur 44 is lowered and damages the CD-R. Further, when the slide cover 81 is pulled out, as is shown in FIG. 11, the slide cover 81 interacts with the hooks 84, which are then disengaged from the guide rails 993 of the lower case 99. As a result, the CD conveying unit 8 is released from the main body of the recording apparatus 1.

The tray 83 used for the embodiments is a 2 to 3 mm thick resin plate. As is shown in FIG. 13, a CD attachment portion 832, an operating portion 833, which is grasped by an operator when inserting or removing the tray 83, detection marks 834 (in FIG. 13, five marks, 834A, 834B, 834C, 834D and 834E), which are formed, as portions to be detected, by using a highly reflective material, a CD removal hole 835, and insertion position alignment marks 836 (two marks in FIG. 13) are provided for the resin plate. In addition, the tray sheet 831 is attached to the distal end of the tray 83 so that the tray 83 can be securely gripped by the conveying roller 36 and the pinch roller 37.

The detection marks 834A is a reference position detection mark for determining the detection position of the tray 83. The detection mark 834B is a confirmation detection mark that, in addition to the reference position detection mark 834A, is used to detect the position of the tray 83. The detection marks 834C and 834D are reverse insertion detection marks for detecting whether the tray 83 has been inserted in a direction opposite the normal direction. The detection mark 834E is a recording material presence/absence detection mark for determining whether a recording member has been loaded on the tray 83.

First Embodiment

Figure 14:
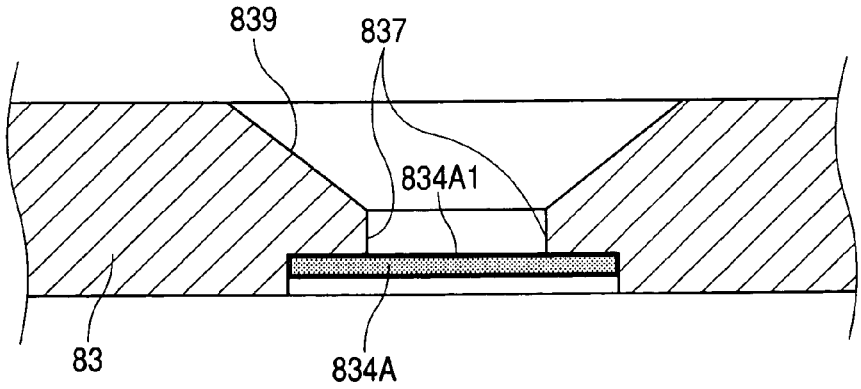
FIG. 14 is a vertical cross-sectional view of the structure of a tray position detector according to a first embodiment of the present invention.
Figure 15:
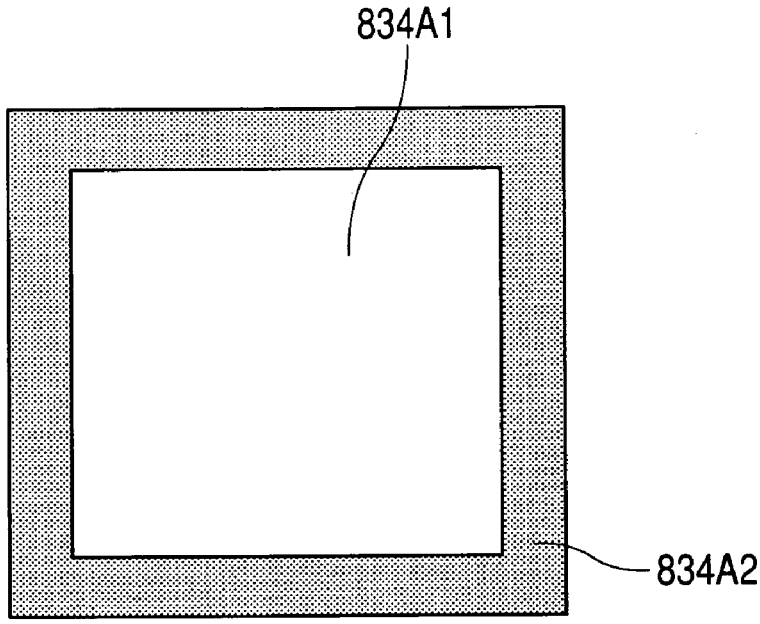
FIG. 15 is a plan view of a reflection plate of the tray position detector in FIG. 14.
Figure 16:
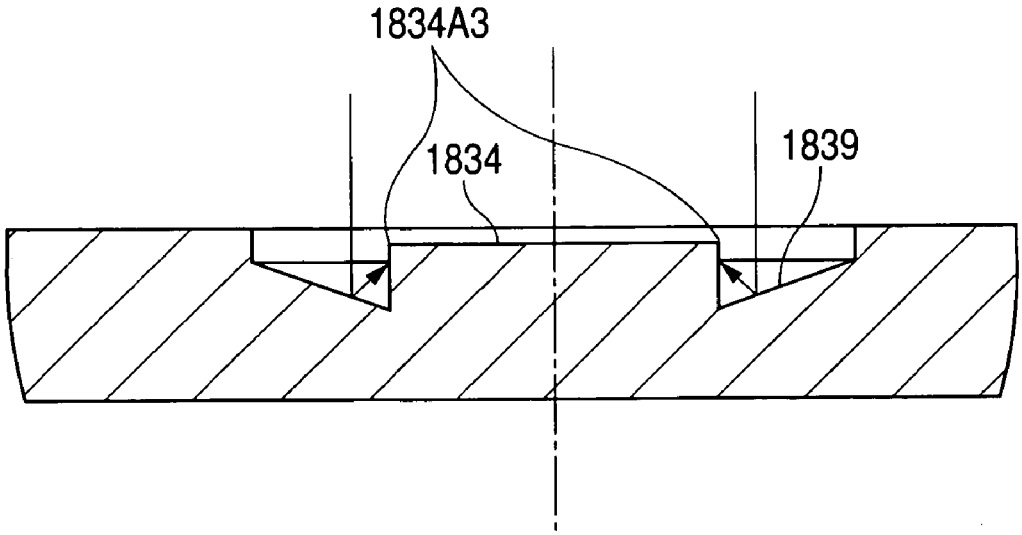
FIG. 16 is a schematic vertical cross-sectional view of an example reference structure for the tray position detector.
Figure 17:
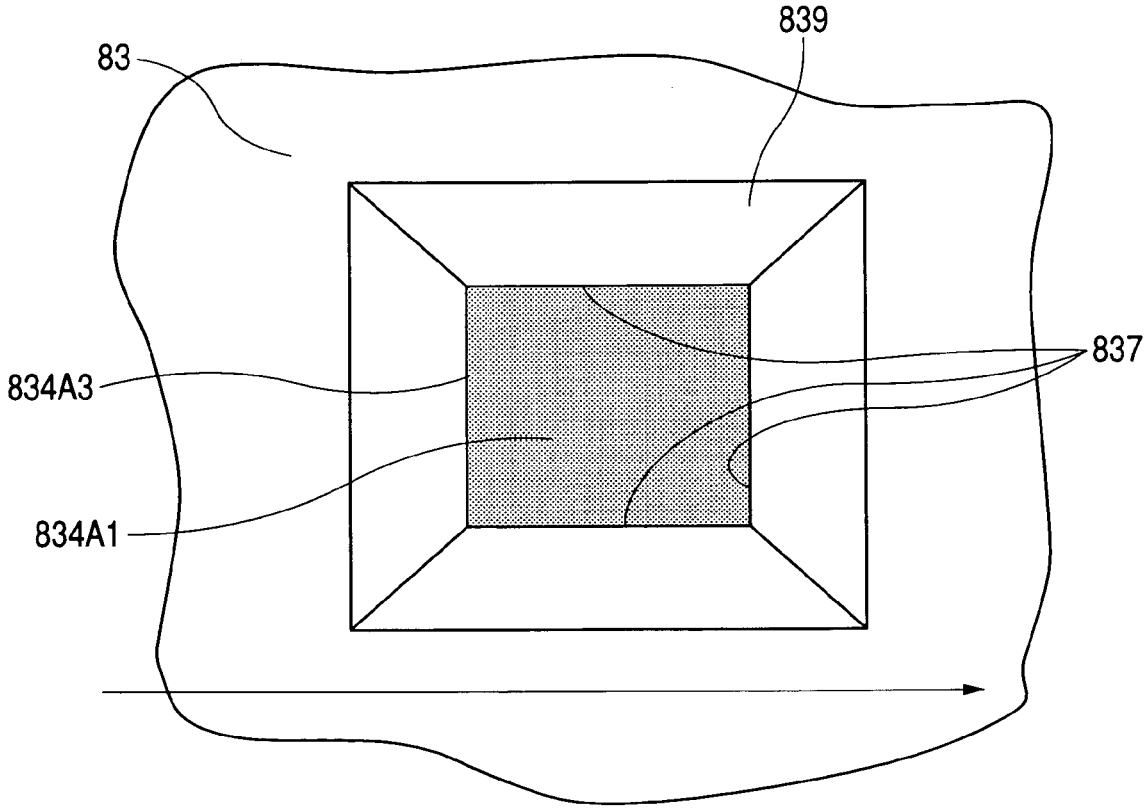
FIG. 17 is a fragmentary plan view for explaining the positional relationship between a tray and a position sensor according to the first embodiment of the invention.
Figure 18:
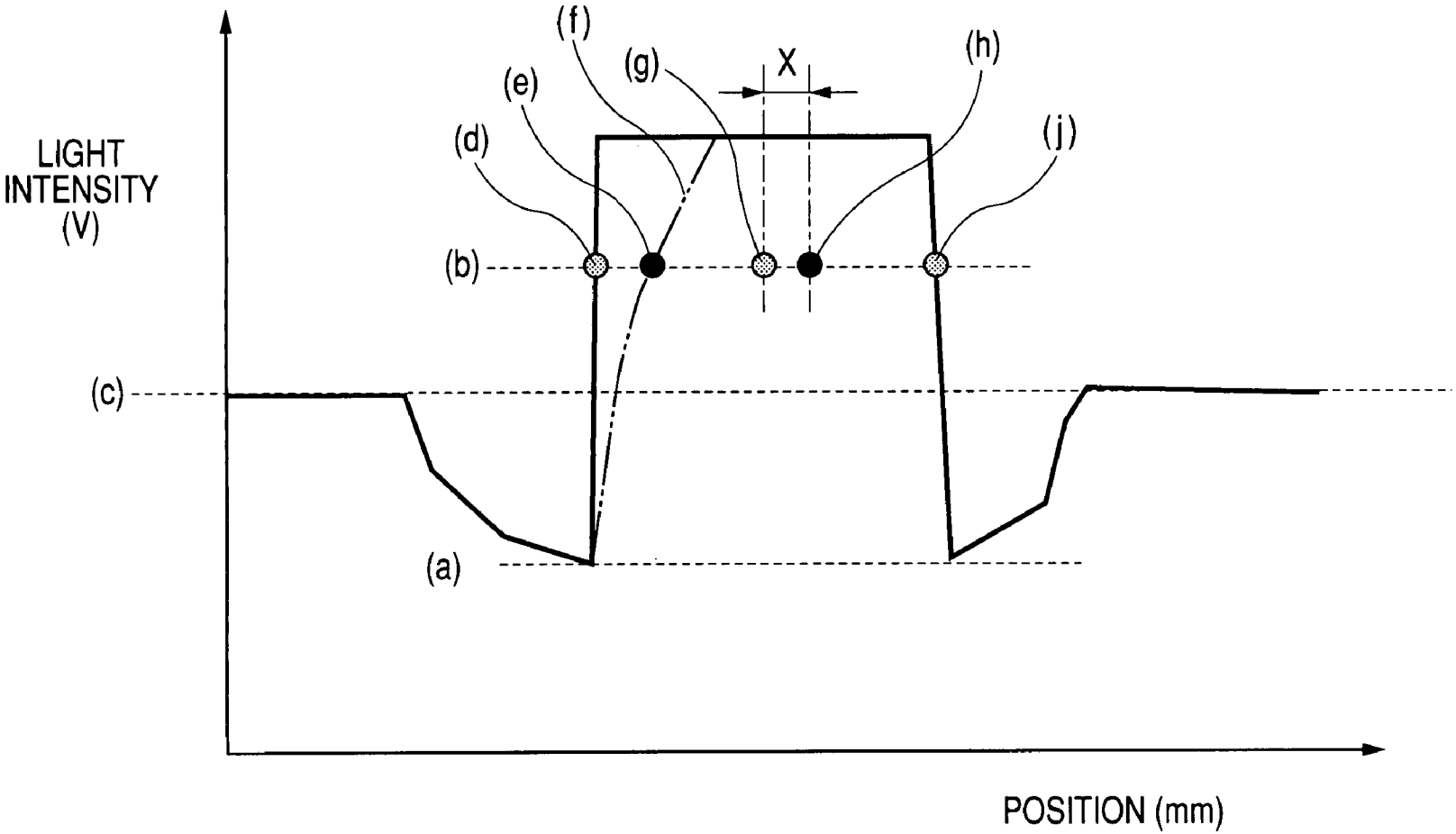
FIG. 18 is a graph showing as an example a change in light intensity during a reflection plate detection sequence for detecting the location of the tray according to the first embodiment of the invention.
Figure 19A:
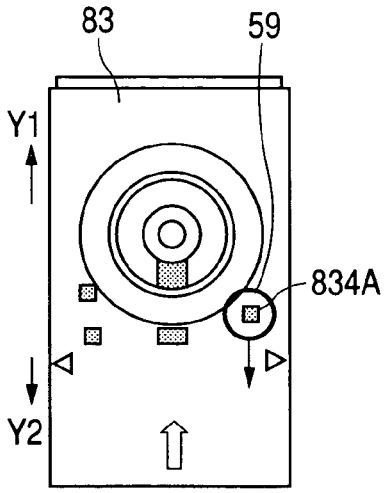
FIGS. 19A, 19B, 19C, 19D, 19E and 19F are diagrams for explaining the processing for detecting a detection mark when the tray is inserted in the normal direction.
Figure 19B:
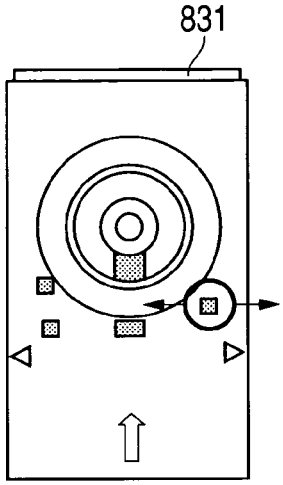
Figure 19C:
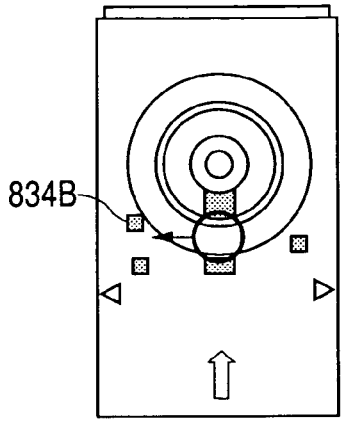
Figure 19D:
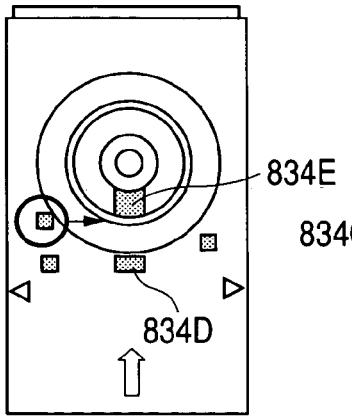
Figure 19E:
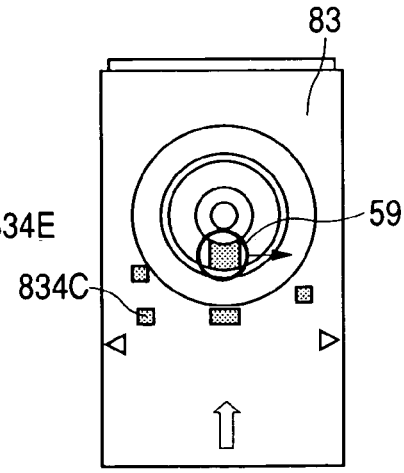
Figure 19F:
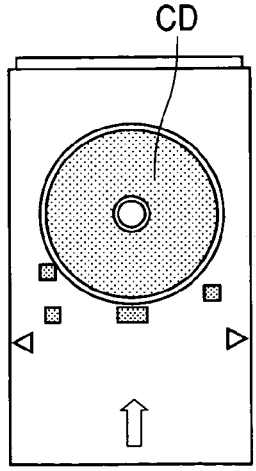
Figure 20A:
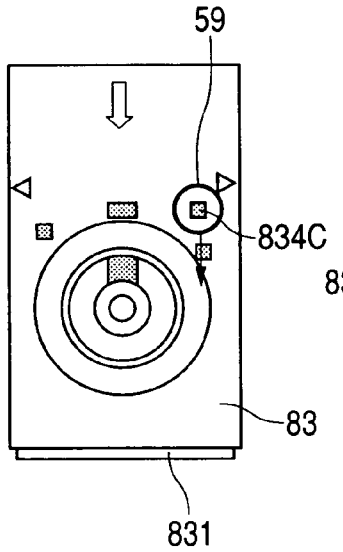
FIGS. 20A, 20B and 20C are diagrams for explaining the processing for detecting the detection mark when the tray is inserted in the opposite direction.
Figure 20B:
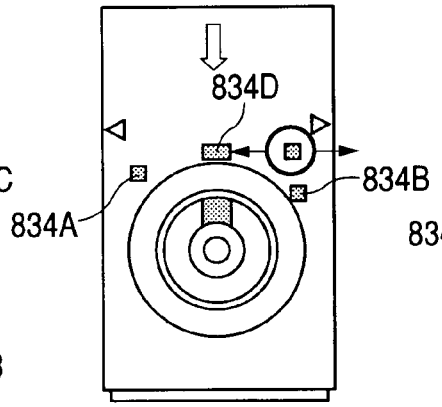
Figure 20C:
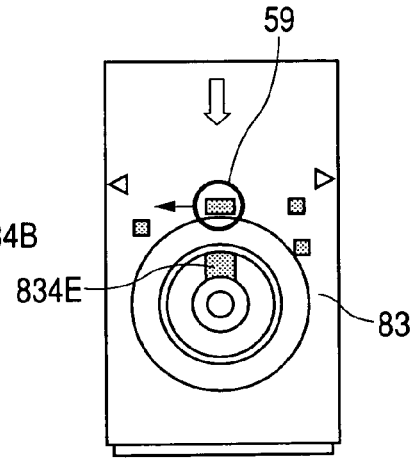

First, an explanation will be given for the structures of detection marks 834, according to a first embodiment, that function as portions to be detected. FIG. 14 is a vertical cross-sectional view of the structure of a reference position detection mark 834A according to the first embodiment. FIG. 15 is a plan view of a reflection plate of the reference position detection mark 834A in FIG. 14. FIG. 16 is a schematic vertical cross-sectional view of an example reference for the reference position detection mark 834A. FIG. 17 is a fragmentary plan view for explaining the relative position of a sensor 59 that functions as the position detection means according to the first embodiment. FIG. 18 is a graph showing as an example a change in the light intensity during the reflection plate detection process sequence for detecting the position of a tray 83 according to the first embodiment. FIGS. 19A, 19B, 19C, 19D, 19E and 19F are diagrams for explaining the operation for detecting the detection marks when the tray 83 is inserted in the normal direction. FIGS. 20A, 20B and 20C are diagrams for explaining the operation for detecting the detection marks 834 when the tray 83 is inserted in the reverse direction.

Figure 21:
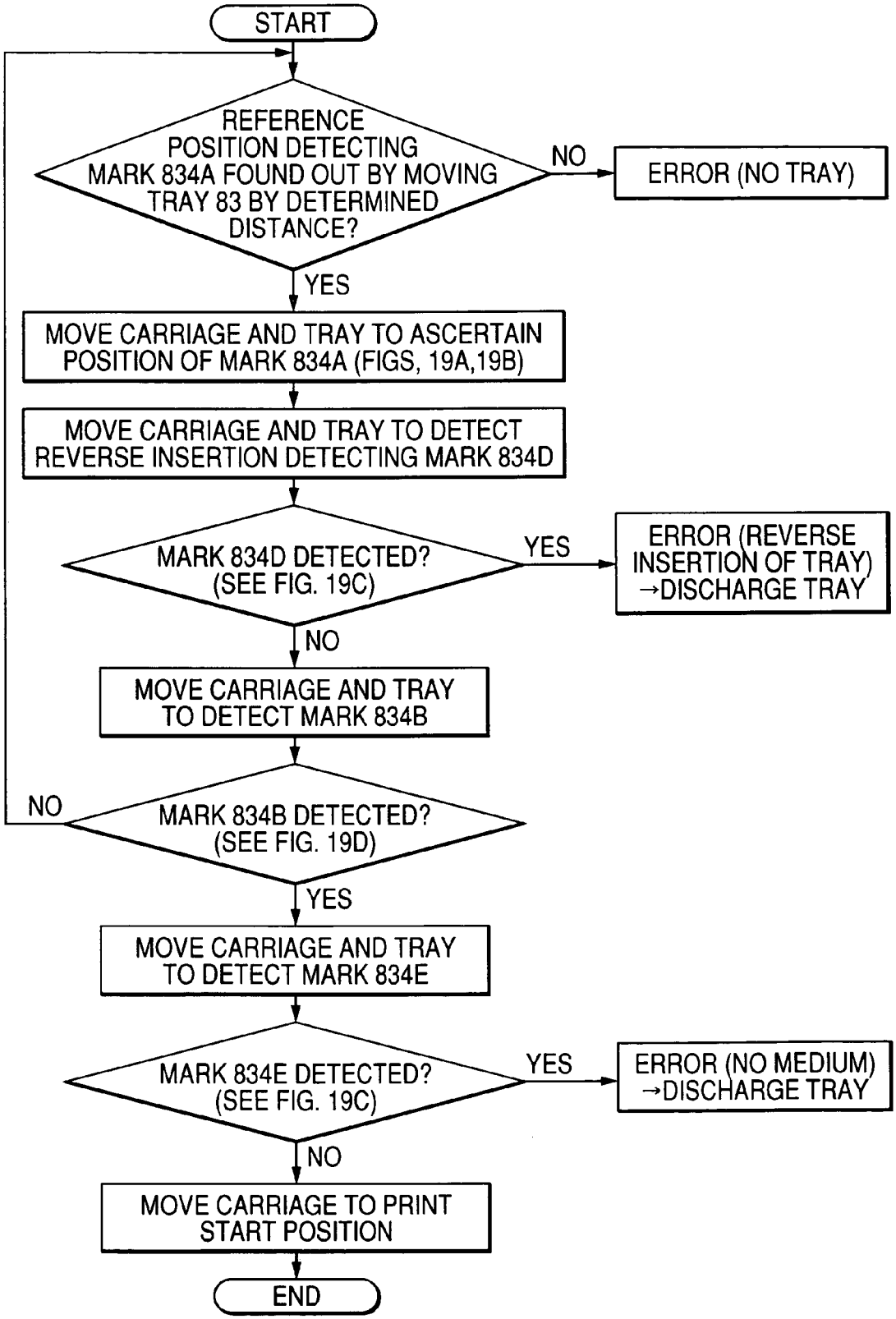
FIG. 21 is a flowchart showing a detection sequence performed by the recording apparatus of the invention using the detection mark on the tray.
Figure 22:
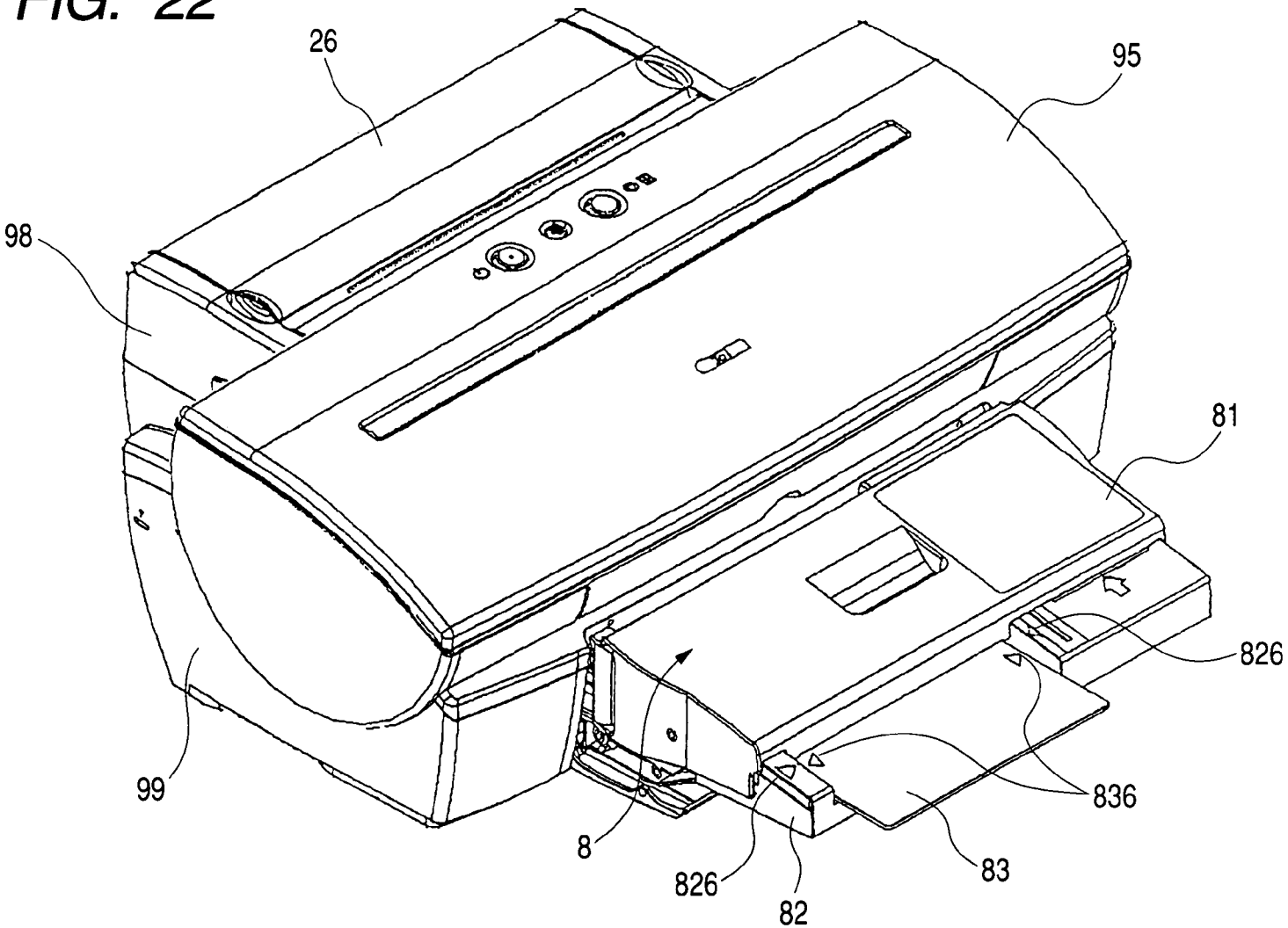
FIG. 22 is a schematic perspective view of the recording apparatus of the invention wherein the tray is set.
Figure 23:
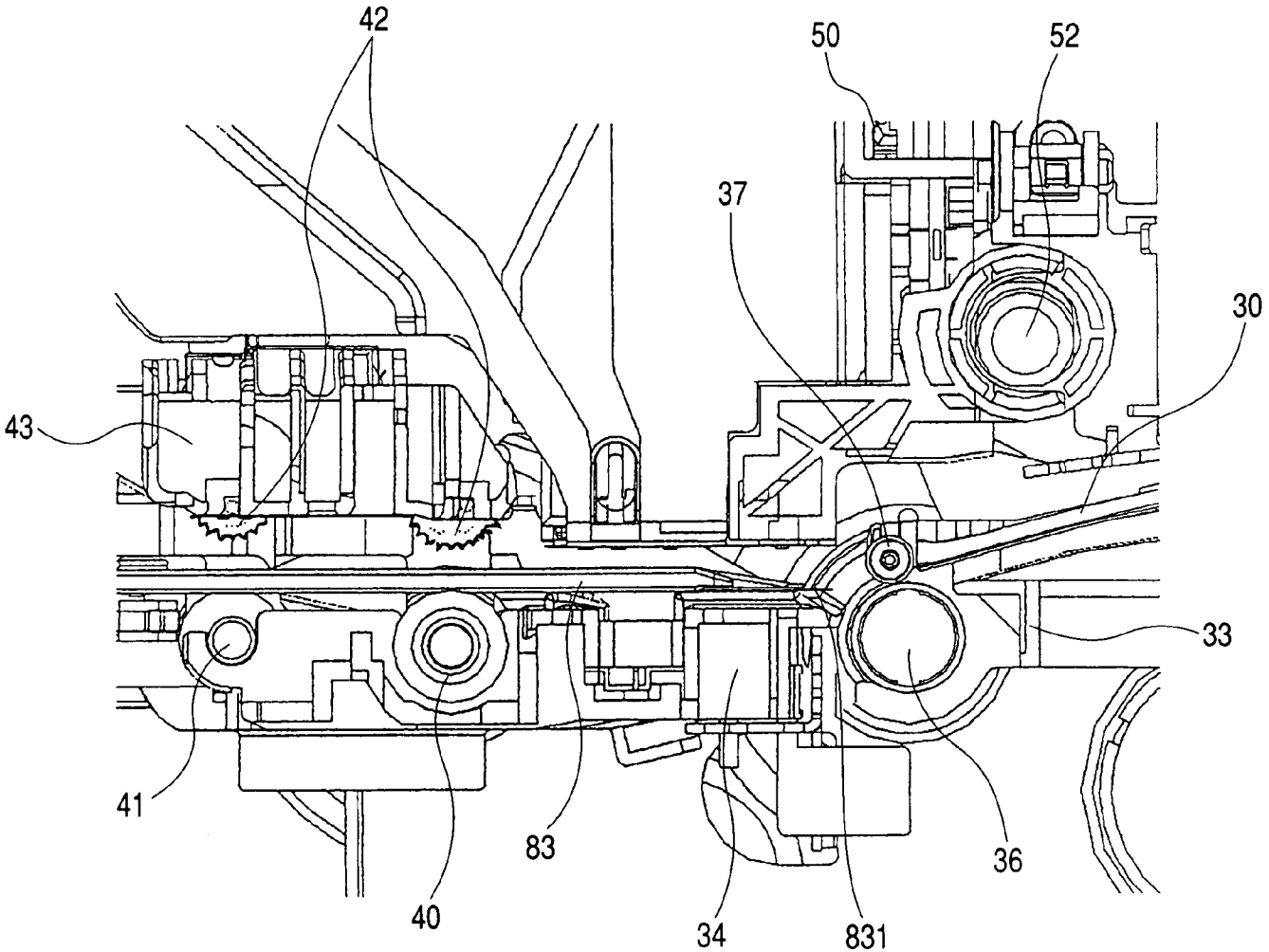
FIG. 23 is a vertical cross-sectional view of the recording apparatus of the invention wherein the tray is conveyed.
Figure 24A:
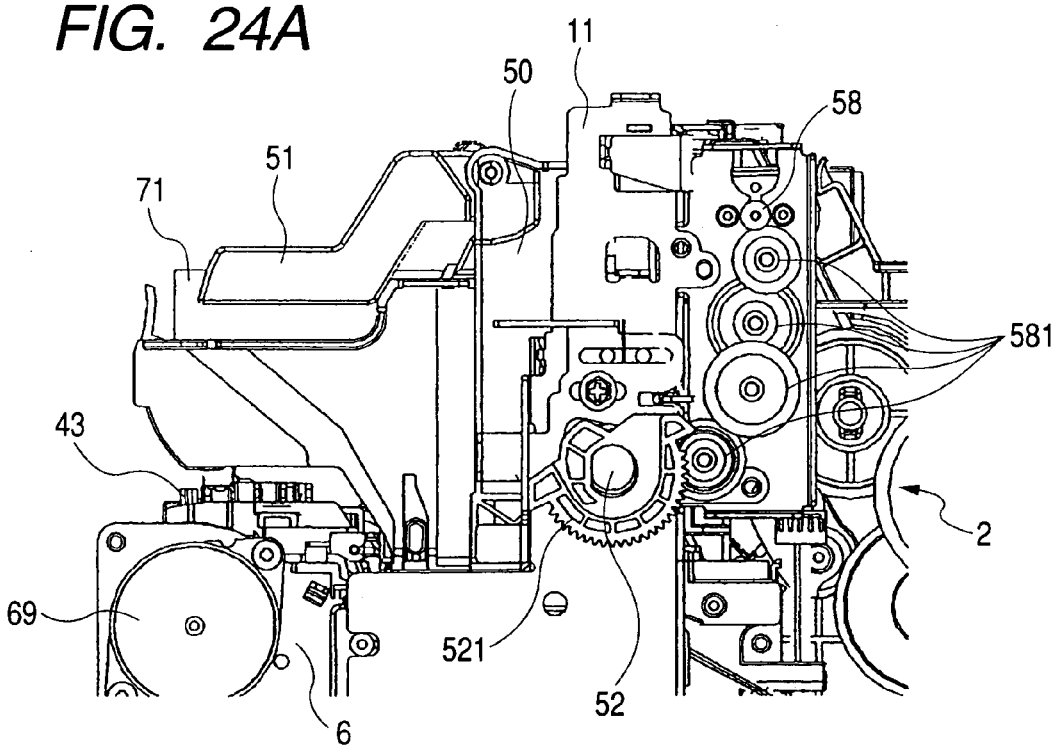
FIGS. 24A and 24B are fragmentary cross-sectional views for explaining the arrangement and the operation of a carriage guide shaft elevating mechanism provided for the recording apparatus of the present invention, with FIG. 24A showing the operation for lowering a carriage and FIG. 24B showing the operation for raising the carriage.
Figure 24B:
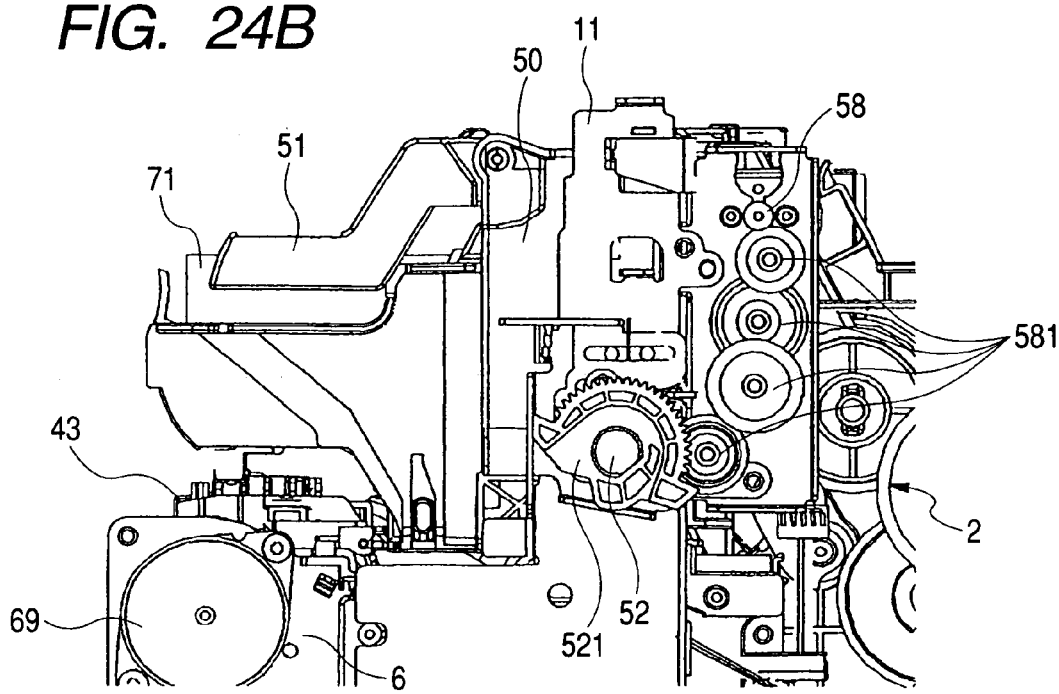
Figure 25:
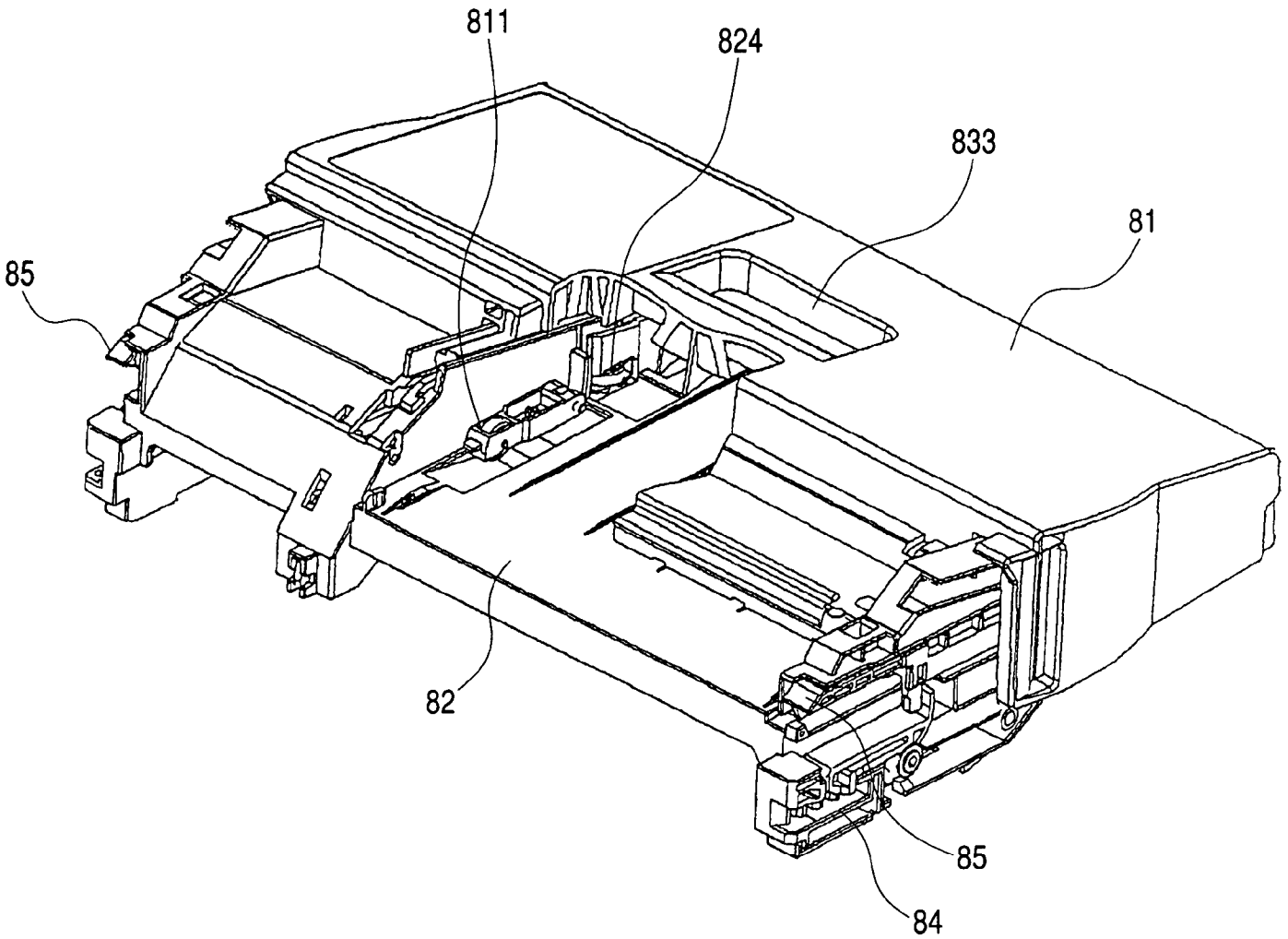
FIG. 25 is a schematic perspective view for explaining the actions, relative to the tray, of a side pressure roller and a pressing roller of the CD conveying unit of the recording apparatus according to the invention.

FIG. 21 is a flowchart showing the detection mark detection process sequence performed by a recording apparatus 1 according to the present invention. FIG. 22 is a schematic perspective view of the state wherein the tray 83 is set into the recording apparatus 1 according to the present invention. FIG. 23 is a vertical cross-sectional view of the state wherein the tray is conveyed into the recording apparatus 1 according to the present invention. FIG. 24 is a fragmentary vertical cross-sectional view for explaining the configuration and the operation of a carriage guide shaft elevating mechanism for the recording apparatus 1 according to the invention. FIG. 25 is a schematic perspective view for explaining the actions, relative to the tray 83, of a side pressure roller and a pressing rollers of a CD conveying unit 8 of the recording apparatus according to the invention.

In FIGS. 13 and 14, the reference position detection mark 834A is a portion to be detected, which is used for determining the position of the tray 83 and also as a reference for a CD printing position. The greatest accuracy is required for the detection of the reference position detection mark 834A. This is true, because since the reference position detection mark 834A and the position of the CD are predesignated, the positioning accuracy and the detection of the reference position detection mark 834A directly affect the recording position accuracy. As is shown in FIG. 14, the reference position detection mark 834A having a reflective face 834A1 is fitted, from the reverse face of the tray 83, into a recessed portion formed in the reverse face of the tray 83. As is shown in FIG. 15, double-sided tape 834A2 is attached around the reflective face 834A1 of the reference position detection mark 834A to enable the adhesion of the reference position detection mark 834*a* to the tray 83. Another method can be employed to attach the reference position detection mark 834A to the tray 83, and a snap fitting method or a gap filling method, for example, may be employed.

When the sensor 59 reads the position, the position is determined by using the edge of the detection mark 834. In this embodiment, vertical faces 837 of the tray 83 are detected as the edges of the reference position detection mark 834A. Since the vertical faces 837 are part of the tray 83, the positioning relative to the CD attachment portion 832 can be very accurate. The reading accuracy is not affected when the reference position detection mark 834, which is made of a different material than is the tray 83, is slightly shifted and adhered. Furthermore, since the reflective faces 834A1 are present in the recessed portions in the surface of the tray 83, the reflective faces 834A1 are seldom scratched. With this arrangement, a recording apparatus can be provided that has a reliable CD printing function having a very high recording accuracy.

In this embodiment, the reference position detection mark 834A is formed by depositing aluminum on the surface of a resin (PET). The thickness of the reference position detection mark 834A is about 0.1 to 2.0 mm, and the size is about 3 to 10 mm square. The reflectivity of the reflective faces 834A1 is about 50 to 98%, and inclined faces 839 are formed around the tray vertical faces 837. Since the surfaces of the inclined faces 839 are bright finished, the light emitted by the sensor 59 provided in the carriage 50 is not returned by these inclined faces 839 to a light receiving unit. Therefore, the amount of light (the light intensity) that the light receiving unit receives from the reflective faces 834A1 can greatly differ, so that the accuracy with which the reflector is detected is even more increased.

The CD printing start position is located at the lower portion in the outermost circle shown in FIG. 13, and the reference position detection mark 834A is arranged near the CD printing start position. Therefore, after the position of the CD has been established by the reference position detection mark 834A, the distance the tray 83 is moved to the CD printing start position is comparatively reduced. As a result, an error caused by moving the tray 83 becomes insignificant, and more accurate printing is enabled. An explanation will now be given for a difference in the reflector between an example reference and the first embodiment. In FIG. 16 showing the example reference for the tray reference position detector (reflector), a position detector 1834 on a tray 83 is a reflective face formed by hot stamping, and inclined faces 1839 are formed around the reflective face 1834. In this example reference, when corners 1834A3, which are the edges of the reflective faces 1834, do not form complete angles, the reflective face 1834 does not become horizontal, which causes an error in the detection of the position of the reflector 1834. Since the tray 83 is made of resin, it is actually very difficult to obtain corners 1834A3 that form complete angles.

On the other hand, according to this embodiment, as is shown in FIG. 14, even if the upper and lower corners of the vertical faces 837 of the tray 83 do not form edges, the edges of the reflective face 834A1 can be precisely detected. While referring to FIGS. 17 and 18, the first embodiment will be explained in further detail. FIG. 17 is a top view of the reflectors in FIGS. 14 and 16 (the same top view is applied). FIG. 18 is a graph showing the relationship between the light intensity, which is detected by the sensor 59 mounted on the carriage 50, and the position of the sensor 59. That is, FIG. 18 is a graph showing the results obtained by tracing the reflection plate in the direction indicated by an arrow in FIG. 17. Generally, as is indicated at point (c) in FIG. 18, a small amount of light reflected by the surface of the tray 83 is also detected, and as the sensor 59 moves to the positions of the inclined faces 839, little reflected light is returned, so that the light intensity is reduced, as is indicated at point (a) in FIG. 18.

The confirmation of the reflective face 834A1 is performed by a difference between the light intensities at points (a) and (b) in FIG. 18. Since the difference in the light intensity is increased because the inclined faces 839 are provided, it is apparent that a light intensity margin for position detection can be obtained. In FIG. 14, showing the structure of the embodiment, since the ends of the reflective face 834A1 are detected at points (d) and (j) in FIG. 18, the center point (g) is the position of the reflective face 834A, and accurate position detection can be performed. However, according to the example reference in FIG. 16, when, for example, one of the corners 834A3 is rounded (R), reflective light tracing, indicated by a dashed double-dotted line (f) in FIG. 18, is performed, so that the ends of the reflective face 1834 are detected at points (e) and (j) in FIG. 18, and point (h) in FIG. 18 is the position of the reflective face 1834. Therefore, for the example reference in FIG. 16, relative to the accurate position detected in FIG. 14 for the embodiment, a distance error is caused that is equivalent to the distance indicated by X in FIG. 18. As is described above, according to this embodiment, the possibility that this error will be caused can be eliminated.

Unlike the reference position detection mark 834A, high position accuracy is not required for the other detection marks 834B, 834C, 834D and 834E in FIG. 13, because these marks are detected by determining the presence or the absence of the reflection plate. Therefore, the structure shown in FIG. 16 may be employed, or as a simpler structure, through holes may be formed in the tray 83. So long as a difference in the reflected light can to a degree be obtained, the through holes can be employed for the detection of the presence or absence of the tray 83 (or the CD). That is, aside from the reference position detection mark 834A, the detection marks 834B to 834E may be formed on the face opposite the sensor 59.

In FIG. 13, to position a CD that has been loaded and to remove play, a plurality of mold pawls are provided on the CD attachment portion 832. An operator aligns the center hole of a CD with the CD attachment portion 832, which is located one step lower than the other face of the tray 83. The recording member presence/absence detection mark 834E is provided on the lower face, and since this mark 834E is exposed when no CD is mounted on the tray 83, it can be determined that a recording member has not been mounted.

The confirmation detection mark 834B is used to confirm the reference position detection mark 834A. That is, in order to prevent an erroneous detection when a reflective material is attached to a CD or to the tray 83, it can be determined that the reference position detection mark 834A has been correctly detected, on the occasion that both the reference position detection mark 834A and the confirmation detection mark 834B are detected.

In FIG. 13, the tray sheet 831 is formed at the distal end of the tray 83 so that the conveying roller 36 and the pinch roller 37 can securely grip the tray 83. The tray sheet 831 is a sheet member having a thickness of about 0.1 to 0.3 mm, and is made, for example, of PET and has a predetermined friction coefficient and a predetermined hardness. Further, a tapered portion 830 is formed at the distal end of the tray 83. First, a conveying force is generated by griping the tray sheet 831 between the conveying roller 36 and the pinch roller 37, and the tapered portion 830 at the distal end of the tray 83 is raised by the pinch roller 37. In this manner, the thick tray 83 can be held between the conveying roller 36 and the pinch roller 37 and can thus enable the conveying of the tray 83.

In FIG. 25, a side pressure roller is provided in the tray guide 82 of the CD conveying unit 8 to press the tray 83 against the reference face of the tray guide 82, and the tray 83 is positioned when the tray 83 is pressed against the reference face under a predetermined pressure by a roller spring 825. Pressing rollers 811 are provided on the right and left sides of a slide cover 812, and when the tray 83 is pressed against the paper discharge roller 41 under a predetermined pressure by a roller spring 812, the force for conveying the tray 83 is generated. When the printing is started, the tray 83 can be moved, by this conveying force, from the set position to the nip portion formed by the conveying roller 36 and the pinch roller 37. Further, when the printing has been completed, the tray 83 can be moved, by the conveying force, to a predetermined position whereat the tray 83 can be extracted by the operator. In this case, the detection marks 834 and the pressure rollers 811 are arranged at different positions. Therefore, contact of the position detection marks 834 with the pressing rollers 811 is avoided and the surfaces of the position detection marks 834 are protected from being scratched. When the tray 83 conveyed to the predetermined position is pulled out, the tray 83 can be removed from the tray guide 82.

While referring to FIGS. 19A and 19B to 21, an explanation will be given for the CD printing operation and the detection mark reading sequence performed while using the above described configuration. When the CD conveying unit 8 is slid straightly toward the main body of the recording apparatus 1, the CD conveying unit 8 is loaded into the lower case 99. At this time, the tray guide sensor 344 can detect that the tray guide 82 has been loaded into the main body of the recording apparatus 1. When the slide cover 81 is moved farther toward the main body of the recording apparatus 1, the arms 85 interact with the slide cover 81 and are projected outward toward the main body. Then, the arms 85 are inserted between the spur holder 43 and the platen 34, and raise the spur holder 43 by a predetermined distance.

In this state, when the slide cover 81 is moved toward the main body of the recording apparatus 1, the slide cover 81 is shifted obliquely upward, and the opening 821 (FIGS. 6A and 6B) appears between the tray guide 82 and the slide cover 81. At this time, as is shown in FIG. 22, the tray 83 whereon a CD is mounted can be inserted and set at a predetermined position. Thus, the operator holds the operating portion 833 and inserts the tray 83 until the position detection marks 834 match tray set marks 826 on the tray guide 82.

In this state, when a host transmits recording data, the recording operation is initiated. First, as is shown in FIG. 23, the conveying roller 36 and the discharge rollers 40 and 41 are reversely rotated. Since the force for conveying the tray 83 is generated by the tray 83 being pressed against the discharge rollers 40 and 41 under a predetermined pressure by the pressing rollers 811 and the roller spring 812, the tray 83 is conveyed into the recording apparatus 1 according to the reverse rotation of the discharge rollers 40 and 41. When the tray sheet 831 is gripped by the conveying roller 36 and the pinch roller 37, a predetermined conveying force is generated, and the pinch roller 37 is raised by the tapered portion 830 formed at the distal end of the tray 83. Thus, the tray 83 is sandwiched by the conveying roller 36 and the pinch roller 37.

Following this, the carriage 50 is moved from the home position to the recording area to detect the tray 83. At this time, as is shown in FIGS. 24A and 24B, the guide shaft 52 is raised by the carriage elevating motor 58, and an optimal gap can be formed for the tray 83. Instead of this process, the pinch roller holder 30, which holds the pinch roller 37, may be actuated to separate the pinch roller from the conveying roller 36 to obtain a tray conveying space.

The process sequence performed by the sensor 59 for detecting the detection marks 834 on the tray 83 will now be described while referring to FIGS. 19A and 19B to 21. FIGS. 19A and 19B are diagrams for explaining the operation wherein the sensor 59 traces the detection marks 834 when the tray 83 is inserted in the normal direction. FIGS. 20A, 20B and 20C are diagrams for explaining the operation wherein the sensor 59 traces the detection marks 834. FIG. 21 is a flowchart showing this detection processing. For this processing, the direction in which the carriage 50 moves is defined as the X direction, and the direction in which the tray 83 is moved is defined as the Y direction. A case wherein the tray 83 is inserted in the normal direction will initially be explained. First, in FIG. 19A, the carriage 50 is halted at a position whereat the sensor 59 faces the reference position detection mark 834A on the tray 83. Then, the tray 83 is moved in the direction Y1 shown in FIG. 19A, and the upper edge position of the reference position detection mark 834A is detected. Thereafter, the tray 83 is further moved in the direction Y1, and the lower edge of the reference position detection mark 834*a* is detected. Then, the tray 83 is moved in the direction Y2 so that the sensor 59 is located substantially in the center of the reference position detection mark 834A in the Y direction. Next, as is shown in FIG. 19B, the carriage 50 is moved to the right and the left (X direction), and the right edge and the left edge of the reference position detection mark 834A are detected.

Through the above operation, the center position of the reference position detection mark 834A is calculated, and based on the center position, the printing position of a CD mounted on the tray 83 is obtained. Since the position of the tray 83 is detected in the above-mentioned manner, the printing on the CD does not cause the misalignment due to a variance in the accuracy of parts and the state of the tray 83, as compared with printing performed based only on mechanical accuracy without the position detection process. Furthermore, since the CD attachment portion 832 and the edge of the reference position detection mark 834A are provided by the same part, and since part assembly accuracy is not accumulated, high positioning accuracy can be obtained. Thereby enabling accurate CD printing.

After the position of the reference position detection mark 834A has been detected, the carriage 50 is moved to detect the confirmation detection mark 834B. During this movement, as is shown in FIG. 19C, the reverse insertion detection mark 834D is detected in order to confirm that the tray 83 has not been reversely inserted. In the Y direction, the reverse insertion detection marks 834C and 834D are located at the same positions, and are shifted away from the reference position detection mark 834A. Therefore, after the reference position detection mark 834A has been detected, and when only the carriage 50 is moved, without the tray 83 being moved in the Y direction, the reverse insertion detection mark 834D is not detected. And when the reverse insertion mark 834D is not detected, it is ascertained that the tray 83 has been inserted in the normal direction, not in the reverse. Following this, the carriage 50 is moved in the X direction, and the tray 83 is moved in the direction Y for the detection of the confirmation detection mark 834B (FIG. 19D). When the confirmation detection mark 834B is not detected, it is ascertained that the previous detection of the reference position detection mark 834A was not correct, and that the edge of a CD, a pattern printed on the CD or the like has been erroneously detected. Therefore, the process for detecting the reference position detection mark 834A is performed again.

The re-detection process is repeated until the total conveyance amount of the tray 83 reaches a predetermined value. When the confirmation detection mark 834B is detected, it is ascertained that the previous detection of the reference position detection mark 834A was correct, and the next operation is initiated. Then, the carriage 50 is moved in the X direction, and the tray 83 is moved in the direction Y1 for the detection of the recording member presence/absence detection mark 834E (FIG. 19E). When the recording member presence/absence detection mark 834E is detected, it is ascertained that a CD has not been mounted, the printing operation is suspended, the tray 83 is discharged to a predetermined position, and a medium absence error is displayed. When a CD has been mounted on the tray 83, as is shown in FIG. 19F, the recording member presence/absence detection mark 834E is not detected, so that it is ascertained that a CD has been mounted and the printing operation is continued.

While referring to FIGS. 20A, 20B and 20C, an explanation will now be given for a case wherein the tray 83 is erroneously inserted in the reverse direction. As is shown in FIG. 13, the distance in the X direction, between the reverse insertion detection mark 834C and an end 83B of the tray 83, is substantially equal to the distance between the reference position detection mark 834A and an end 83A of the tray 83. That is, when the tray 83 is inserted in the normal direction, the position whereat the carriage 50 is halted to face the reference position detection mark 834A, which corresponds to the position of the reverse insertion detection mark 834C the tray 83 is inserted in the reverse direction. When the tray 83 is inserted in the reverse direction, first, the position of the reverse insertion detection mark 834C is detected (FIG. 20A), and then the upper and lower ends and the right and the left ends of the reverse insertion detection mark 834C are detected to obtain the center position of the reverse insertion detection mark 834C. At this time, that the tray 83 has been inserted in the reverse direction cannot be detected, and it is determined that the reference position detection mark 834A has been detected.

Following this, the carriage 50 is moved in the X direction to detect the reverse insertion detection mark 834D (FIGS. 20B and 20C). As previously described, since the reverse insertion detection marks 834C and 834D are located at the same positions in the Y direction, the reverse insertion detection mark 834D is detected when the tray 83 is inserted in the reverse direction. And when the reverse insertion detection mark 834D is detected, it is ascertained that the tray 83 has been inserted in the reverse direction. When the tray 83 is inserted in the reverse direction, it is not easily advanced toward the main body of the recording apparatus 1 because the tray sheet 31 is not provided on that side. However, the tray 83 can be forcibly inserted in the reverse direction. In case of a modification of the embodiment, wherein, during the CD printing, not only the carriage 50 but also the pinch roller 37 are actuated together to perform retraction upward by a motor to obtain a paper path for the tray 83, at the beginning of the process, it is easy to insert the tray 83 in the reverse direction. Therefore, a tray reverse insertion detection means is required.

When the reverse insertion detection marks 834C and 834D are not provided and the tray 83 is inserted in reverse, first, the position confirmation is performed, based on the confirmation detection mark 834B, to detect the reference position detection mark 834A. As a result, the confirmation detection mark 834B is erroneously regarded as the reference position detection mark, and the printing is initiated at the incorrect position. Therefore, the reverse insertion detection marks 834C and 834D are required to prevent the printing of a shifted position on a CD. Further, for example, a reflection plate (detection mark) for detection of a reverse face may be provided on the reverse face of the tray 83 to detect that the tray 83 has been invertedly positioned.

After the above described series of initial processes is completed, the tray 83 is moved to a predetermined position whereat the printing of the entirety of a CD mounted thereon can be accomplished. Thereafter, the printing is begun in accordance with image data received from the host. So-called multi-path printing for forming an image by performing a plurality of scans can be employed to reduce uneven bands that occur owing to the tray conveying accuracy, the landing accuracy of ink ejected by the recording head 7. etc. When the printing had been completed, the tray 83 is conveyed to a location whereat the operator set the tray 83 to the tray guide 82 before the printing was initiated. At this time, the operator can remove the tray 83 on which the printed CD is mounted. Further, when the operator pulls the slide cover 81, the arms 85 are disengaged from the spur holder 43, and the hooks 84 are disengaged from the lower case 99. As a result, the CD conveying unit 8 can be released and removed from the main body of the recording apparatus 1. With the above described configuration, and by employing the above described operation, there is provided a recording apparatus which can accurately print a small, thick recording member, such as a CD with a simple operation by employing a tray.

According to the above described embodiment, the recording apparatus 1 comprises: the tray conveying unit for conveying the tray 83 on which a small and thick recording member, such as a CD, is mounted; the recording head 7, which functions as means capable of recording on the recording member mounted on the tray, based on recording information; the to-be-detected portions 834, which are provided on the tray 83 and are used to detect the position of the tray 83; and the position detection means 59, for detecting the to-be-detected portions 834 on the tray 83 to obtain the position of the tray 83, whereby the edges of the to-be-detected portions 834 are regarded as the end faces of holes 837 formed in the tray 83. With this arrangement, by positional detection of the tray 83 itself, the position of the tray 83 is accurately detected for recording using thick paper or a CD-R. In addition, the to-be-detected portions can be protected from being scratched, and a reliable recording apparatus that can accurately perform printing can be provided at a low cost.

Furthermore, according to this embodiment, multiple to-be-detected portions 834 are provided on the tray 83, and at least one to-be-detected portion 834A is formed of a reflective material. This reflective material is attached to the tray 83 from the side opposite that facing the position detection means 59, and the reflective face 834A1 is exposed through the hole 837 in the tray 83 so as to determine the position of the tray 83 by the reflective material. Further, the to-be-detected portions 834B to 834E, other than the at least one to-be-detected portion 834A, are formed in the side facing the position detection means 59. And in addition, according to the above-mentioned embodiment, the to-be-detected portions 834C and 834D for detecting the reverse insertion are provided on the tray 83 to detect whether the tray 83 is inserted in a direction that differs from the normal direction. Furthermore, the to-be-detected portions 834 consist of reflective faces, which are thin plates made, for example, of aluminum.

Moreover, according to the above embodiment, the recording apparatus 1 comprises: the tray conveying means for conveying the tray 83 on which a small, thick recording member, such as a CD, is mounted; the recording head 7, which functions as means capable of recording on the recording member mounted on the tray 83, based on recording information; the to-be-detected portions 834, which are formed on the tray 83 and are used to detect the position of the tray 83; and the position detection means 59, for detecting the to-be-detected portions 834 to obtain the position of the tray 83, wherein the to-be-detected portions 834 include the to-be-detected portions 834C and 834D, for preventing a reversed insertion, that are used to detect whether the tray 83 has been inserted in a direction differing from the normal direction, and wherein the processing sequence performed by the position detection means 59, for reading the to-be-detected portions 834, includes a sequence for reading the to-be-detected portions 834C and 834D used for preventing a reversed insertion. With this arrangement, the reversed insertion of the tray 83 can be prevented, by the minimum process sequences as required, and a recording apparatus can be provided that can prevent the erroneous printing of a recording member such as a CD.

Second Embodiment

Figure 26:
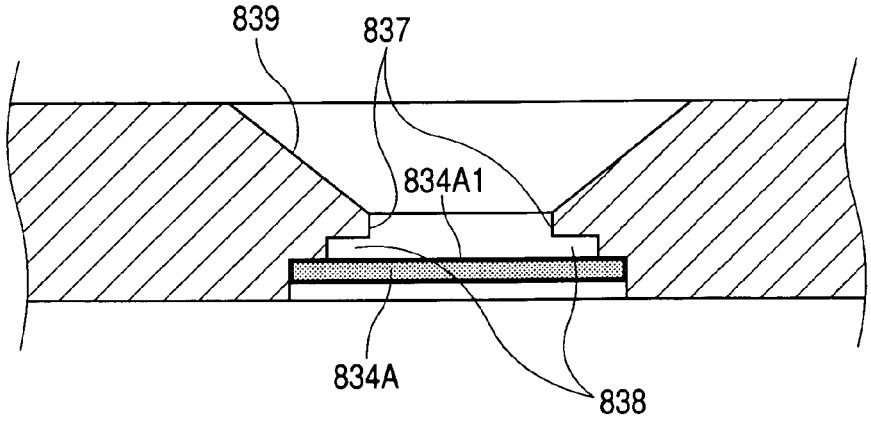
FIG. 26 is a vertical cross-sectional view of the structure of a tray position detector according to a second embodiment of the invention.
Figure 27:
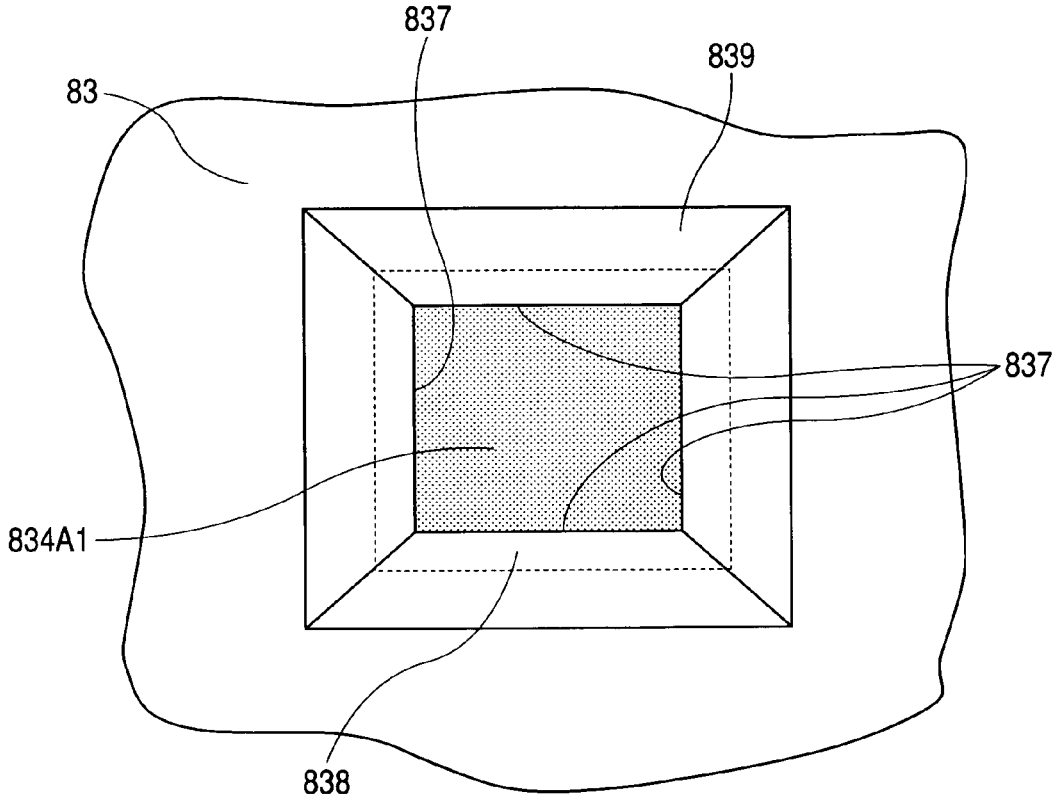
FIG. 27 is a plan view, taken from the surface of a tray, of the tray position detector in FIG. 26.

FIG. 26 is a vertical cross-sectional view of the structure of a tray position detector according to a second embodiment of the present invention. FIG. 27 is a plan view, taken from the surface of a tray, of the tray position detector in FIG. 26. In FIGS. 26 and 27, as in the first embodiment, the edges of a reference position detection mark 834A are determined by vertical faces 837 formed on a tray 83. Therefore, accurate printing can be performed for a small, thick recording member such as a CD. However, a foreign substance, such as ink mist or dust, that is attached to a reflective face 834A1 may affect the detection accuracy. So long as the substance is attached to the center of the reflective face 834A1, it does not greatly affect the detection accuracy; however, where the substance attached near the vertical face 837, deterioration of the edge reading accuracy would occur.

Therefore, in the second embodiment, to evacuate part of such a substance, a substance clearance (or evacuation) space 838 is formed at rear side of the vertical tray faces 837 of the reference position detection mark 834A. That is, this embodiment has substantially the same arrangement as the first embodiment, with the exception that the clearance space 838, for evacuating the substance thereto, is formed around the hole 837 in the tray 83 whereat the reflective face 834A1 of the reference position detection mark 834A is exposed. A mist of ink droplets and dust tends to collect on the reflective face 834A at the corners; however, in this embodiment, since the substance clearance space 838 is formed around the corners of the reflective face 834A1, the possibility can be reduced that the substance will be attached immediately under the vertical faces 837. According to the second embodiment shown in FIGS. 26 and 27, by employing only a simple structure, the reflection plate reading accuracy can be further increased without raising the manufacturing cost, and high quality CD printing can be provided. The other configurations and the other operations performed by the embodiment, explained by referring to FIGS. 26 and 27, are substantially the same as those for the first embodiment.

For the above two embodiments, an ink jet recording apparatus of a serial recording type has been employed that, to perform printing, moves the recording head 7 relative to the recording member. However, the present invention can also be applied for an ink jet recording apparatus of a line recording type, which performs recording only by sub-scanning using line type recording means having a length that covers all or part of the width of the recording member. In this case, the same effects can also be obtained. Furthermore, the present invention can applied for a recording apparatus that employs a single recording means, a color recording apparatus that employs a plurality of recording means, each of which has a different ink color, a gradation recording apparatus that employs a plurality of recording means for printing an image having the same color at different densities, or a recording apparatus that employs a combination of these configurations. In any case, the same effects can be obtained.

The present invention can also be applied for any arbitrary configuration of a recording head and an ink tank, e.g., a configuration employing a replaceable ink cartridge wherein a recording head and an ink tank are integrally formed or a configuration wherein a recording head and an ink tank are separately provided and are connected by an ink supply tube. In this case also, the same effects can be obtained. In addition, the present invention can be applied for an ink jet recording apparatus that employs recording means that uses an electric-mechanical conversion device such as a piezoelectric device. Above all, superior effects can be provided by an ink jet recording apparatus that employs recording means for which thermal energy is used to eject ink, because both the recording density and the resolution can be increased.

This application claims priority from Japanese Patent Application No. 2003-296195 filed Aug. 20, 2003, which is hereby incorporated by reference herein.

What is claimed is:

1. A recording apparatus, which conveys a tray provided with an attachment portion for mounting a recording medium, and which permits a recording head to perform recording on the recording medium mounted on the tray, said apparatus comprising:

a detection mark provided with the tray;

a carriage for moving the recording head, said carriage mounting the recording head thereon; and a sensor, arranged to said carriage, for sensing a position of the detection mark to detect a position of the recording medium mounted on the tray, wherein the detection mark comprises a reflection member, the reflection member is fixed to the tray from a reverse side of a face of the tray opposite to the sensor, and a reflection face of the reflection member is exposed from a hole portion formed in the tray.

2. A recording apparatus according to claim 1, wherein the tray includes a plurality of detection marks, wherein at least one of the detection marks is formed of a reflective material, and wherein the reflective material is attached from a side opposite to a side facing the sensor, and a reflective face of the reflective member is exposed through the hole portion of the tray.

3. A recording apparatus according to claim 2, wherein a plurality of detection marks other than the at least one detection mark are attached to the side facing the position detector.

4. A recording apparatus according to claim 2, wherein a clearance space capable of evacuating foreign material is formed around the hole portion in the tray on which the reflective face of the reflective member is exposed.

5. A recording apparatus according to claim 1, wherein the tray has a detector for detecting whether the tray has been reversely inserted.

6. A recording apparatus according to claim 1, wherein the detection mark has reflective faces comprising thin plates made of aluminum.

7. A tray, comprising:

an attachment portion for mounting a recording medium; and a detection mark which is to be detected by a sensor arranged to a carriage for mounting a recording head, wherein the detection mark comprises a reflection member, the reflection member is fixed to the tray from a reverse side of a face opposite to the sensor, and a reflection face of the reflection member is exposed from a hole portion formed in the tray.

* * * * *